US008646147B2

(12) United States Patent
Conrad

(10) Patent No.: US 8,646,147 B2
(45) Date of Patent: Feb. 11, 2014

(54) SURFACE CLEANING APPARATUS

(75) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 335 days.

(21) Appl. No.: 12/721,457

(22) Filed: Mar. 10, 2010

(65) Prior Publication Data

US 2010/0229338 A1 Sep. 16, 2010

(30) Foreign Application Priority Data

Mar. 13, 2009 (CA) ..... 2658651

(51) Int. Cl.
*A47L 5/00* (2006.01)
*A47L 9/00* (2006.01)

(52) U.S. Cl.
USPC ..... 15/329; 15/327.6; 15/331; 15/334; 15/344

(58) Field of Classification Search
USPC ..... 15/327.6, 329, 331, 334, 344
See application file for complete search history.

(56) References Cited

U.S. PATENT DOCUMENTS

| | | | | |
|---|---|---|---|---|
| 4,393,536 | A * | 7/1983 | Tapp | 15/327.5 |
| 4,395,794 | A | 8/1983 | Duncan | |
| 4,635,315 | A | 1/1987 | Kozak | |
| 5,208,941 | A | 5/1993 | Ettere | |
| 5,309,600 | A | 5/1994 | Weaver et al. | |
| 5,524,321 | A * | 6/1996 | Weaver et al. | 15/329 |
| 5,768,744 | A | 6/1998 | Hamilton | |
| 5,839,157 | A | 11/1998 | Strauser et al. | |
| 6,122,796 | A | 9/2000 | Downham et al. | |
| 7,188,388 | B2 * | 3/2007 | Best et al. | 15/329 |
| 7,350,266 | B2 | 4/2008 | Park et al. | |
| 7,377,007 | B2 | 5/2008 | Best | |
| 7,584,522 | B1 * | 9/2009 | Weeter et al. | 15/350 |
| 2007/0040376 | A1 * | 2/2007 | Choi | 285/275 |
| 2007/0226946 | A1 * | 10/2007 | Best | 15/329 |
| 2007/0289085 | A1 * | 12/2007 | Yoo | 15/334 |
| 2010/0229336 | A1 * | 9/2010 | Conrad | 15/415.1 |
| 2011/0314629 | A1 * | 12/2011 | Conrad | 15/323 |
| 2012/0000030 | A1 * | 1/2012 | Conrad | 15/329 |

* cited by examiner

*Primary Examiner* — Brian Glessner
*Assistant Examiner* — Brian D Mattei
(74) *Attorney, Agent, or Firm* — Philip C. Mendes da Costa; Bereskin & Parr LLP S.E.N.C.R.L., s.r.l.

(57) ABSTRACT

Various uses and constructions for an open sided nozzle for a surface cleaning apparatus are provided. Alternate constructions for a surface cleaning head are also provided.

34 Claims, 23 Drawing Sheets

SURFACE CLEANING APPARATUS

CROSS REFERENCE TO RELATED APPLICATIONS

This application claims the benefit of the filing date of Canadian Patent Application. No. 2658981, filed Mar. 13, 2009 entitled SURFACE CLEANING APPARATUS.

FIELD

The specification relates to surface cleaning apparatus. In one embodiment, the specification relates to a surface cleaning apparatus having a cleaning nozzle wherein the cleaning nozzle comprises an open sides air flow chamber and removably receives a attachment member. In other preferred embodiments, the specification relates to alternate constructions for a surface cleaning head.

INTRODUCTION

The following is not an admission that anything discussed below is prior art or part of the common general knowledge of persons skilled in the art.

Cleaning apparatus that use a cleaning head having an open bottom are known. See for example U.S. Pat. No. 4,395,794; U.S. Pat. No. 5,839,157; U.S. Pat. No. 5,208,941 and U.S. Pat. No. 5,768,744. While cleaning heads have been considered to have uses, typically, commercialized domestic surfacing cleaning apparatus, and in particular vacuum cleaners for household use, have not employed such cleaning heads.

Reconfigurable surface cleaning apparatus have also been developed. These use an independent portable cleaning unit that is removably mounted to a primary cleaning unit or forms part of a primary cleaning unit. See for example U.S. Pat. No. 6,122,796; U.S. Pat. No. 4,635,315; U.S. Pat. No. 5,309,600; U.S. Pat. No. 7,350,266 and U.S. Pat. No. 7,377,007.

SUMMARY

The following introduction is provided to introduce the reader to the more detailed discussion to follow. The introduction is not intended to limit or define the claims.

According to one broad aspect, a surface cleaning apparatus is provided that has a nozzle with an airflow chamber, at least a portion of which is open. Essentially, the surface that is to be cleaned (e.g., a floor or a piece of furniture) forms the bottom side of the airflow chamber. Dirt is entrained in an air stream that is drawn into a dirty air inlet, preferably at the front of the surface cleaning head. Various constructions of an open sided air flow chamber may be used. The nozzle removably is selectively connectable in air flow communication with a remote cleaning head. The remote cleaning head may comprise at least one of an accessory cleaning tool and surface cleaning head provided on an upright vacuum cleaner. Accordingly, the nozzle may receive an auxiliary cleaning tool. Accordingly, the surface cleaning apparatus may be converted to use a different cleaning tool to clean, e.g., a floor. For example, an air turbine powered brush may be selectively mounted to the surface cleaning apparatus. Alternately, or in addition, an above floor cleaning tool, e.g., an attachment that includes a flexible hose to which a cleaning tool may be mounted at the end distal to the nozzle, may be used. Accordingly, the surface cleaning apparatus may be adapted for additional cleaning uses. Essentially, a removable attachment may be employed to convert an open sided nozzle to a traditional nozzle with a traditional dirty air inlet. Alternately, the nozzle may be connectable with a surface cleaning head of an upright vacuum cleaner.

According to another broad aspect, a surface cleaning apparatus, such as an upright vacuum cleaner is provided wherein an air flow path includes two or more sequentially positioned flexible hoses. The upright vacuum cleaner may have a support structure pivotally connected to a surface cleaning head. The vacuum cleaner may also include a surface cleaning unit that is removably mounted on the support structure. The dirty air inlet of the surface cleaning head is connected in fluid communication with the clean air outlet of the surface cleaning unit by an air conduit. The air conduit may include two flexible conduits or hoses that are positioned sequentially (one is upstream of the other). In use, a user may operate the surface cleaning apparatus with the surface cleaning unit attached to the support structure. Optionally, the user may detach the surface cleaning unit from the support structure and move the support structure and surface cleaning head independently from the surface cleaning unit while maintaining the operable fluid connection via the two flexible hoses. The flexible hoses may also be extensible to increase the separation distance between surface cleaning unit and the support structure.

According to another broad aspect, an upright vacuum cleaner is provided having a support structure pivotally connected to a surface cleaning head wherein a flexible hose extends through the pivot member. For example support structure may include a handle portion that is gripped by the user during use. Pivotally connecting the support structure to the surface cleaning head allows the user to easily maneuver the surface cleaning ahead across the surface to be cleaned. The pivotal connection between the surface cleaning head and the support structure may also allow a user to guide the surface cleaning head around obstacles, such as table legs. In addition, the pivotal connection allows the angle and position of the support structure to be changed while the surface cleaning head remains in contact with the floor. This enables users of different heights to comfortably use the vacuum cleaner, and it may reduce the stress and strain experienced by the user when vacuuming. Accordingly, the pivot mount may include mounting arms and may define a passageway or conduit through which a flexible hose or conduit can extend. The surface cleaning apparatus may also include a surface cleaning unit that is removably mounted on the support structure. The dirty air inlet of the surface cleaning head is connected in fluid communication with the clean air outlet of the surface cleaning unit by an air conduit. The air conduit may optionally include two flexible conduits or hoses. In such a case, the upstream flexible hose may pass through the conduit in the pivot mount and the pivot mount may provide a conduit through which the upstream hose and be connected to the downstream hose. Accordingly, part or all of a flexible hose may be stored in or on a surface cleaning head.

When cleaning a room, the user may detach the surface cleaning unit from the support structure and move the support structure and surface cleaning head independently from the surface cleaning unit while maintaining the operable fluid connection via the flexible hoses. This may further reduce the stress and strain experienced by the user when vacuuming. To increase the user's range of movement, one or both of the flexible hoses connecting the surface cleaning unit to the surface cleaning head may be stretchable, and preferably resiliently stretchable so that the hose will return to its unstretched length when released. When not stretched, portions of the flexible hoses may be stored in the surface cleaning head, the support structure or both. The increased length of the hoses as a result of their extensibility may reduce the need for the user to add separate extension hoses or tools to the vacuum cleaner in use, which may reduce the time required to vacuum a room. The resilient nature of the flexible hoses can also keep the hoses under tension when not in use. That is, the connection points at the end of one or more of the flexible hoses may be separated by a path length that is longer than the unstretched length of the hose. Keeping the hoses under tension when not in use may reduce the chances of the hoses becoming tangled and may reduce the chances that slack hose portions may become kinked or create potential tripping hazards for the user.

In another aspect, a hose is mounted to the surface cleaning head under tension. Accordingly, the air flow path comprises a flexible conduit wherein a portion of the flexible conduit is connected to the surface cleaning head at a location forward of a pivot axle for a support structure and another portion is connected to at least one of the support structure and a pivot mount for the support structure. This configuration applies a downward force to the front of the surface cleaning head, to assist in keeping the front of a surface cleaning head on a floor.

In one embodiment, a surface cleaning apparatus may comprise a nozzle, an air outlet and an enclosed airflow passage from the nozzle to the air outlet, an air treatment unit and a suction motor in the airflow passage. The nozzle may comprise an airflow chamber having an open lower side, an opening to the enclosed airflow passage. The nozzle may be selectively connectable in air flow communication with an accessory cleaning tool. It will be appreciated that only part of the lower side of the air flow chamber may be open. However, preferably all or essentially all of the lower side is open.

In another embodiment, the surface cleaning apparatus may have a floor cleaning unit comprising a surface cleaning head having a dirty air inlet and a handle drivingly connected to the surface cleaning head. The surface cleaning apparatus may comprise a portable surface cleaning apparatus having a nozzle, an air outlet and an enclosed airflow passage from the nozzle to the air outlet. The nozzle may comprise an airflow chamber having an open lower side, an opening to the enclosed airflow passage. The nozzle may be selectively connectable in air flow communication with an accessory cleaning tool and the surface cleaning head.

In some examples, the surface cleaning apparatus may further comprise a portable surface cleaning apparatus that comprises the nozzle, the air outlet, the enclosed airflow passage, the air treatment unit and the suction motor, the portable surface cleaning apparatus is removably mounted to a handle that is drivingly connected to a floor cleaning unit comprising a surface cleaning head having a dirty air inlet.

In some examples, the nozzle is selectively connectable in air flow communication with the accessory cleaning tool and the surface cleaning head.

In some examples, the airflow chamber further comprises at least one open side wall and defines a flow passage such that air travels from the at least one open side wall under the portable surface cleaning apparatus to the opening.

In some examples, the surface cleaning apparatus further comprises at least one attachment member, the attachment member connectable in fluid flow communication with the opening.

In some examples, the at least one attachment member comprises an auxiliary cleaning tool.

In some examples, the attachment member comprises a mounting portion removably connectable with the portable surface cleaning apparatus and a flexible hose extending from the auxiliary cleaning tool to the mounting portion.

In some examples, the at least one attachment member comprises an attachment member that is mountable to the floor cleaning unit.

In some examples, the attachment member has an air inlet that is in airflow communication with an air flow conduit extending from the surface cleaning head.

In some examples, the attachment member comprises a mounting portion removably connectable with the portable surface cleaning apparatus and the air inlet is provided on the mounting portion.

In some examples, the at least one attachment member comprises a first attachment member comprising an auxiliary cleaning tool and a second attachment member that is mountable to the floor cleaning unit and has an air inlet that is in airflow communication with the air flow conduit.

In some examples, the at least one attachment member comprises an attachment member that is removably mountable to the floor cleaning unit and comprises a flexible hose that is connectable with an auxiliary cleaning tool and the surface cleaning head.

In some examples, the attachment member has an air inlet and an attachment member passageway that extends in a downstream direction from the air inlet to the opening and the attachment member passageway does not increase in diameter in the downstream direction.

In some examples, the attachment member has an air inlet, an attachment member passageway extends in a downstream direction from the air inlet to the opening, and air traveling from the air inlet to the opening passes through less than a 45° bend.

In some examples, the attachment member has an air inlet, an attachment member passageway that extends in a downstream direction from the air inlet to the opening, and air traveling from the air inlet to the opening travels in a generally straight line.

In some examples, the attachment member is releasably secured to the portable surface cleaning apparatus by at least one magnet.

In some examples, the attachment member is releasably secured to the portable surface cleaning apparatus by a pair of opposed pivotal arms.

In some examples, the arms are provided on the attachment member and are releasably secured to the portable surface cleaning apparatus.

In some examples, the portable surface cleaning apparatus is removably mounted to the handle.

In some examples, the portable surface cleaning apparatus is removably mounted to the handle and the surface cleaning apparatus further comprises a flexible hose extending from the surface cleaning head to the portable surface cleaning apparatus.

In some examples, the portable surface cleaning apparatus is removably mounted to the handle and the surface cleaning apparatus further comprises a flexible hose extending from the surface cleaning head to the attachment member.

In some examples, the portable surface cleaning apparatus comprises a hand vacuum cleaner and the nozzle is configured for directly cleaning a surface.

In another embodiment there is provided a surface cleaning apparatus comprises a surface cleaning head. The surface cleaning head may comprise a front, a rear, a dirty air inlet and a cleaning head air outlet. An air flow path may extend from the dirty air inlet to a clean air outlet and the air flow path includes at least one of an air treatment unit and a suction motor. The air flow path may comprise an upstream flexible conduit and a downstream flexible conduit.

In some examples, the downstream flexible conduit is proximate the upstream flexible conduit.

In some examples, an upstream end of the downstream flexible conduit is releaseably connected to a downstream end of the upstream flexible conduit.

In some examples, the surface cleaning apparatus comprises a surface cleaning unit removably mounted to the surface cleaning apparatus and positioned in the air flow path.

In some examples, the surface cleaning unit is operable when removed from the air flow path.

In some examples, the surface cleaning unit is removably mounted to the surface cleaning apparatus together with the downstream flexible conduit.

In some examples, the surface cleaning unit is removably mounted to the surface cleaning apparatus and is removable from air flow communication with the downstream flexible conduit.

In some examples, the surface cleaning unit comprises a hand vacuum cleaner.

In some examples, the surface cleaning apparatus comprises a support structure moveably mounted to the surface cleaning head and having provided thereon the air treatment unit and the suction motor.

In some examples, the upstream flexible conduit and the downstream flexible conduit extend from the cleaning head air outlet to the support structure.

In some examples, the support structure is moveably mounted to the surface cleaning head adjacent the rear wheels.

In some examples, the support structure is pivotally mounted to the surface cleaning head coaxial with an axle of the rear wheels.

In some examples, the support structure is pivotally mounted to the surface cleaning about a pivot axis wherein the pivot axis is at least as rearward as an axle of the rear wheels.

In some examples, the support structure has an absence of a housing defining a recess for receiving the surface cleaning unit.

In some examples, the upstream flexible conduit is under tension.

In some examples, the surface cleaning apparatus comprises a support structure that is pivotally mounted to the surface cleaning head. The upstream flexible conduit may be under tension and have a portion connected to the surface cleaning head at a location forward of a pivot axle for the support structure and another portion is connected to at least one of the support structure and a pivot mount for the support structure.

In some examples, the surface cleaning apparatus comprises a support structure pivotally mounted to the surface cleaning head by a pivot mount and the pivot mount includes a housing having a passage and at least a portion of the upstream flexible conduit extends through the passage.

In some examples, the upstream flexible conduit comprises a stretch hose.

In some examples, the downstream flexible conduit comprises a stretch hose.

In some examples, the surface cleaning unit is useable in a first configuration wherein the surface cleaning unit is mounted on the support structure and at least one additional configuration wherein the surface cleaning unit is removed from the support structure and attached in air flow communication with the surface cleaning head or wherein the surface cleaning unit is removed from the support structure and removed from air flow communication with the surface cleaning head.

In some examples, the surface cleaning unit is useable in a first configuration wherein the surface cleaning unit is mounted on the support structure, a second configuration wherein the surface cleaning unit is removed from the support structure and attached in air flow communication with the surface cleaning head and a third configuration wherein the surface cleaning unit is removed from the support structure and removed from air flow communication with the surface cleaning head.

In some examples, the upstream flexible conduit is stored as part of the surface cleaning head.

In some examples, the upstream flexible conduit is mounted to the surface cleaning head and is extendable while in fluid flow communication with the cleaning head air outlet.

In some examples, the surface cleaning comprises a support structure pivotally mounted to the surface cleaning head and a pivot mount comprising a housing having a passage wherein at least a portion of one of the flexible conduits is positioned in the passage.

In some examples, the downstream flexible conduit extends from the pivot mount to the support structure.

In some examples, the surface cleaning apparatus comprises a surface cleaning unit removably mounted to the surface cleaning apparatus and positioned in the air flow path and the downstream flexible conduit comprises at least part of an air flow path extends to an air inlet of the surface cleaning unit.

In another embodiment, a surface cleaning apparatus may comprise a surface cleaning head comprising a front, a rear, a dirty air inlet and a cleaning head air outlet, a support structure pivotally mounted to the surface cleaning head and an air flow path extending from the dirty air inlet to a clean air outlet. The air flow path may include at least one of an air treatment unit and a suction motor. The air flow path may comprise a flexible conduit that is under tension, wherein a portion of the flexible conduit is connected to the surface cleaning head at a location forward of a pivot axle for the support structure and another portion is connected to at least one of the support structure and a pivot mount for the support structure.

In some examples, the pivot mount includes a housing having a passage and at least a portion of the flexible conduit extends through the passage.

In some examples, the flexible conduit comprises a stretch hose.

In some examples, the surface cleaning apparatus may comprise a surface cleaning unit removably mounted to the surface cleaning apparatus and positioned in the air flow path.

In some examples, the surface cleaning unit is operable when removed from the air flow path.

In some examples, the surface cleaning unit is removably mounted to the surface cleaning apparatus together with the flexible conduit.

In some examples, the surface cleaning unit is removably mounted to the surface cleaning apparatus and is removable from air flow communication with the flexible conduit.

In some examples, the surface cleaning unit comprises a hand vacuum cleaner.

In some examples, the at least one of an air treatment unit and a suction motor are provided on the surface cleaning head and having provided thereon the at least one of an air treatment unit and a suction motor.

In some examples, the support structure is moveably mounted to the surface cleaning head adjacent the rear wheels.

In some examples, the support structure is pivotally mounted to the surface cleaning head coaxial with an axle of the rear wheels.

In some examples, the support structure is pivotally mounted to the surface cleaning about a pivot axis wherein the pivot axis is at least as rearward as an axle of the rear wheels.

In some examples, the support structure has an absence of a housing defining a recess for receiving the surface cleaning unit.

In some examples, the flexible conduit is under tension.

In some examples, the flexible conduit is under tension, has a portion connected to the surface cleaning head at a location forward of a pivot mount for the support structure and another portion is connected to at least one of the support structure and the pivot mount.

In some examples, the support structure is pivotally mounted to the surface cleaning head by a pivot mount and the pivot mount includes a housing having a passage and at least a portion of the flexible conduit extends through the passage.

In some examples, the surface cleaning unit is useable in a first configuration wherein the surface cleaning unit is mounted on the support structure and at least one additional configuration wherein the surface cleaning unit is removed from the support structure and attached in air flow communication with the surface cleaning head or wherein the surface cleaning unit is removed from the support structure and removed from air flow communication with the surface cleaning head.

In some examples, surface cleaning unit is useable in a first configuration wherein the surface cleaning unit is mounted on the support structure, a second configuration wherein the surface cleaning unit is removed from the support structure and attached in air flow communication with the surface cleaning head and a third configuration wherein the surface cleaning unit is removed from the support structure and removed from air flow communication with the surface cleaning head.

In another embodiment there is a surface cleaning apparatus that comprises a surface cleaning head. The cleaning head may have a front, a rear, a dirty air inlet and a cleaning head air outlet. The surface cleaning apparatus may also comprise a support structure pivotally mounted to the surface cleaning head, a pivot mount comprising a housing having a passage; and, an air flow path extending from the dirty air inlet to a clean air outlet. The air flow path may include at least one of an air treatment unit and a suction motor. The air flow path may comprise a flexible conduit and at least a portion of the flexible conduit may extend through the passage.

In some examples, the flexible conduit comprises a stretch hose.

In some examples, the surface cleaning apparatus comprises a surface cleaning unit removably mounted to the surface cleaning apparatus and positioned in the air flow path.

In some examples, the surface cleaning unit is operable when removed from the air flow path.

In some examples, the surface cleaning unit is removably mounted to the surface cleaning apparatus together with the flexible conduit.

In some examples, the surface cleaning unit is removably mounted to the surface cleaning apparatus and is removable from air flow communication with the flexible conduit.

In some examples, the surface cleaning unit comprises a hand vacuum cleaner.

In some examples, the at least one of an air treatment unit and a suction motor are provided on the support structure.

In some examples, the support structure is moveably mounted to the surface cleaning head adjacent the rear wheels.

In some examples, the support structure is pivotally mounted to the surface cleaning head coaxial with an axle of the rear wheels.

In some examples, the support structure is pivotally mounted to the surface cleaning about a pivot axis wherein the pivot axis is at least as rearward as an axle of the rear wheels.

In some examples, the support structure has an absence of a housing defining a recess for receiving the surface cleaning unit.

In some examples, the flexible conduit is under tension.

In some examples, the flexible conduit is under tension and has a portion that is connected to the surface cleaning head at a location forward of a pivot mount for the support structure. The flexible conduit has another portion that is connected to at least one of the support structure and the pivot mount.

In some examples, the surface cleaning unit is useable in a first configuration wherein the surface cleaning unit is mounted on the support structure and at least one additional configuration wherein the surface cleaning unit is removed from the support structure and attached in air flow communication with the surface cleaning head or wherein the surface cleaning unit is removed from the support structure and removed from air flow communication with the surface cleaning head.

In some examples, the surface cleaning unit is useable in a first configuration wherein the surface cleaning unit is mounted on the support structure, a second configuration wherein the surface cleaning unit is removed from the support structure and attached in air flow communication with the surface cleaning head and a third configuration wherein the surface cleaning unit is removed from the support structure and removed from air flow communication with the surface cleaning head.

It will be appreciated that an embodiment may contain one or more of features set out in the examples,

DRAWINGS

In the detailed description, reference will be made to the following drawings, in which.

Figure 1:
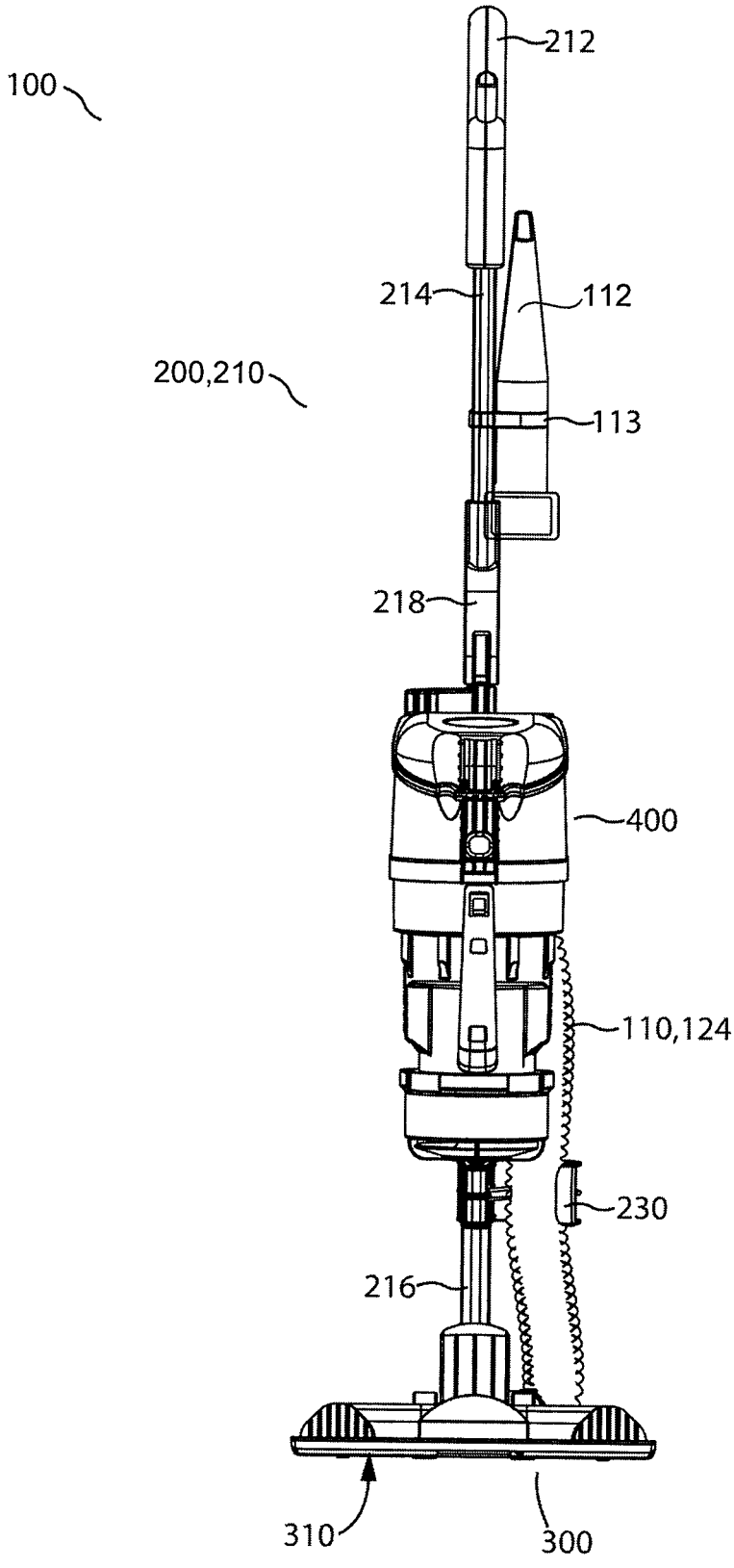
FIG. 1 is a front elevation view of an example of a vacuum cleaner.
Figure 3A:
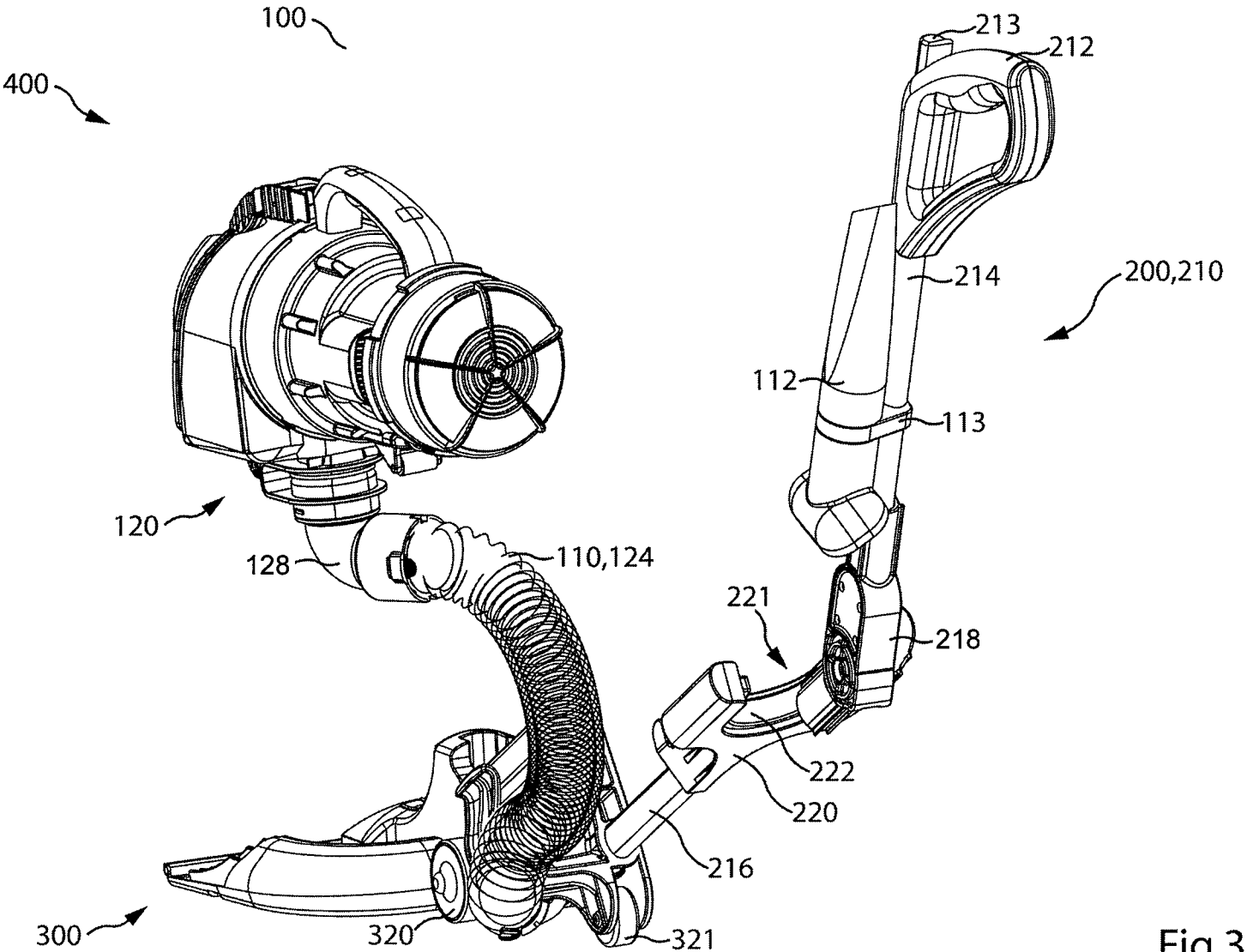
Figure 3B:
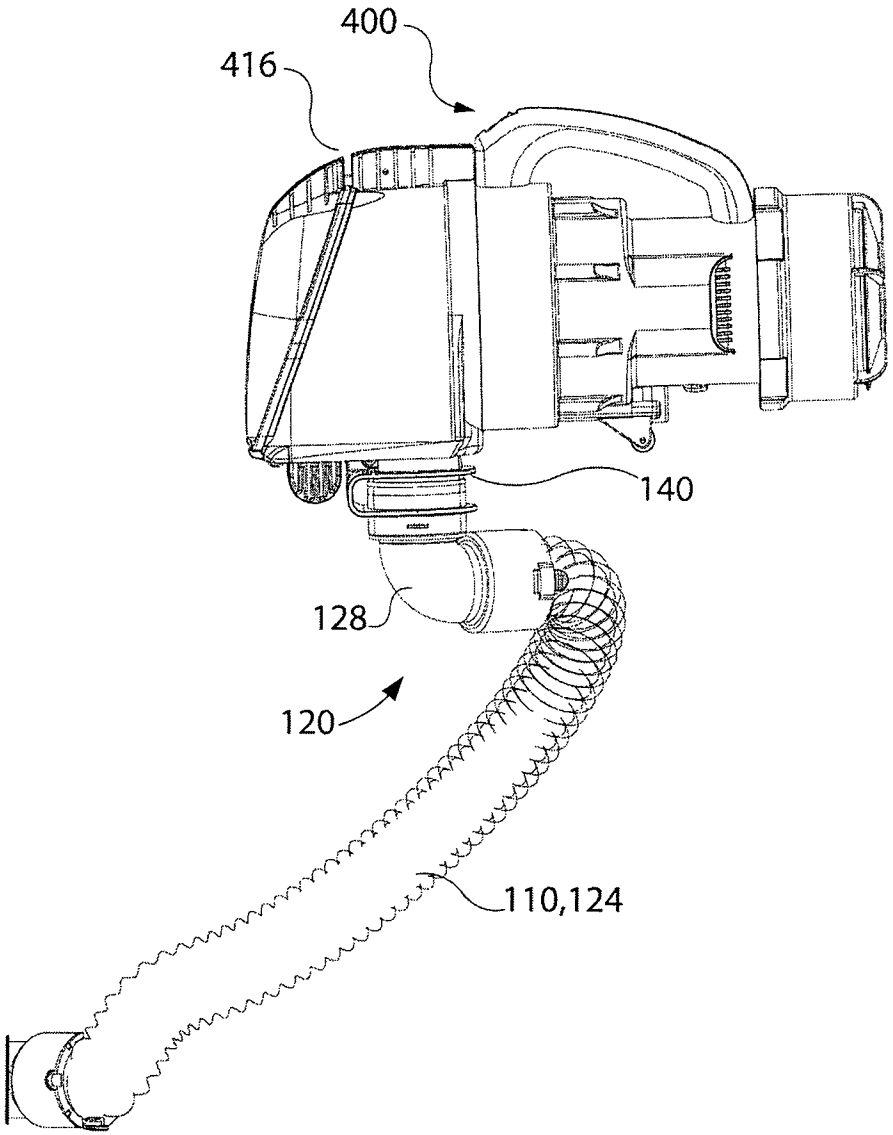
Figure 4:
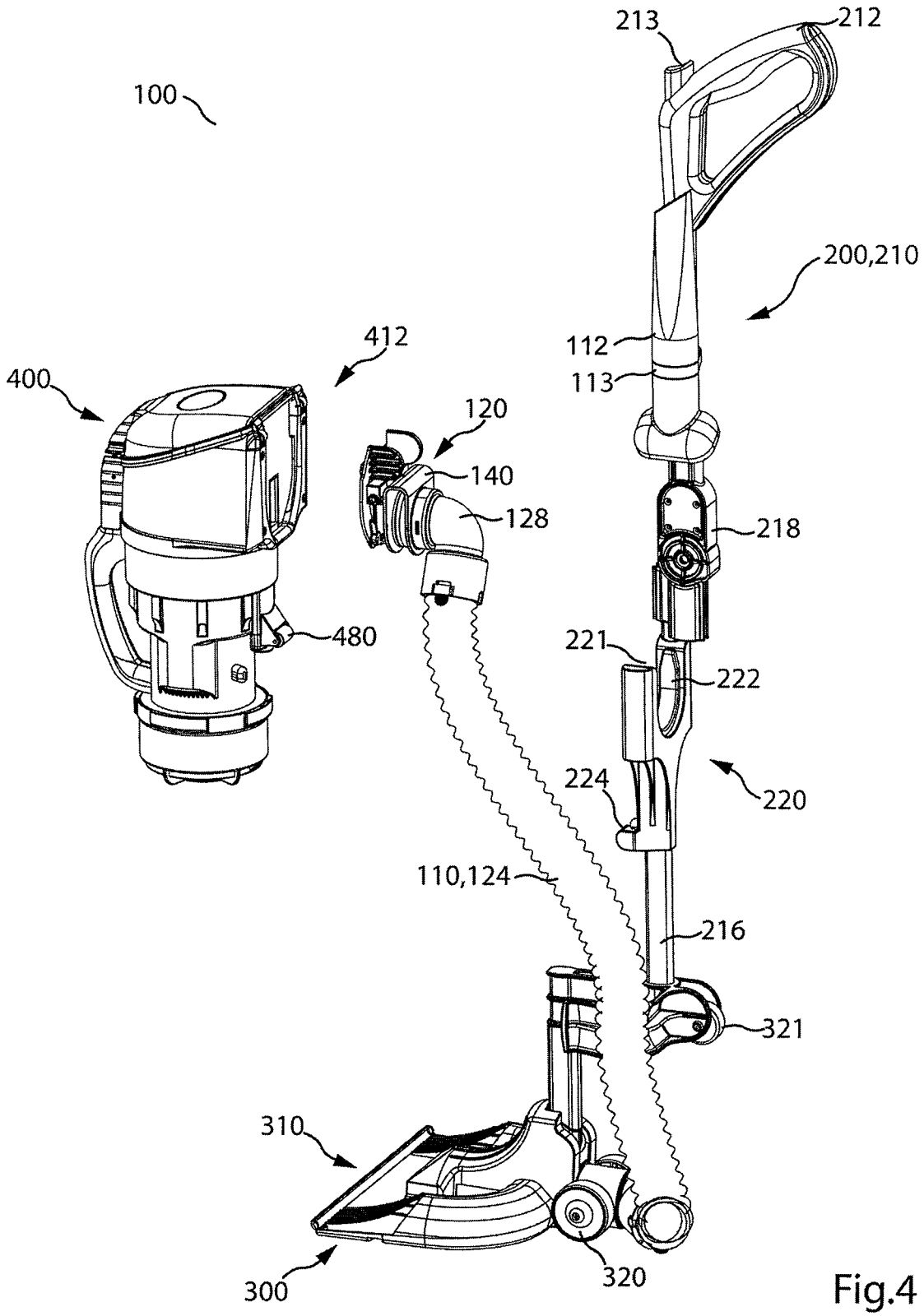
Figure 5:
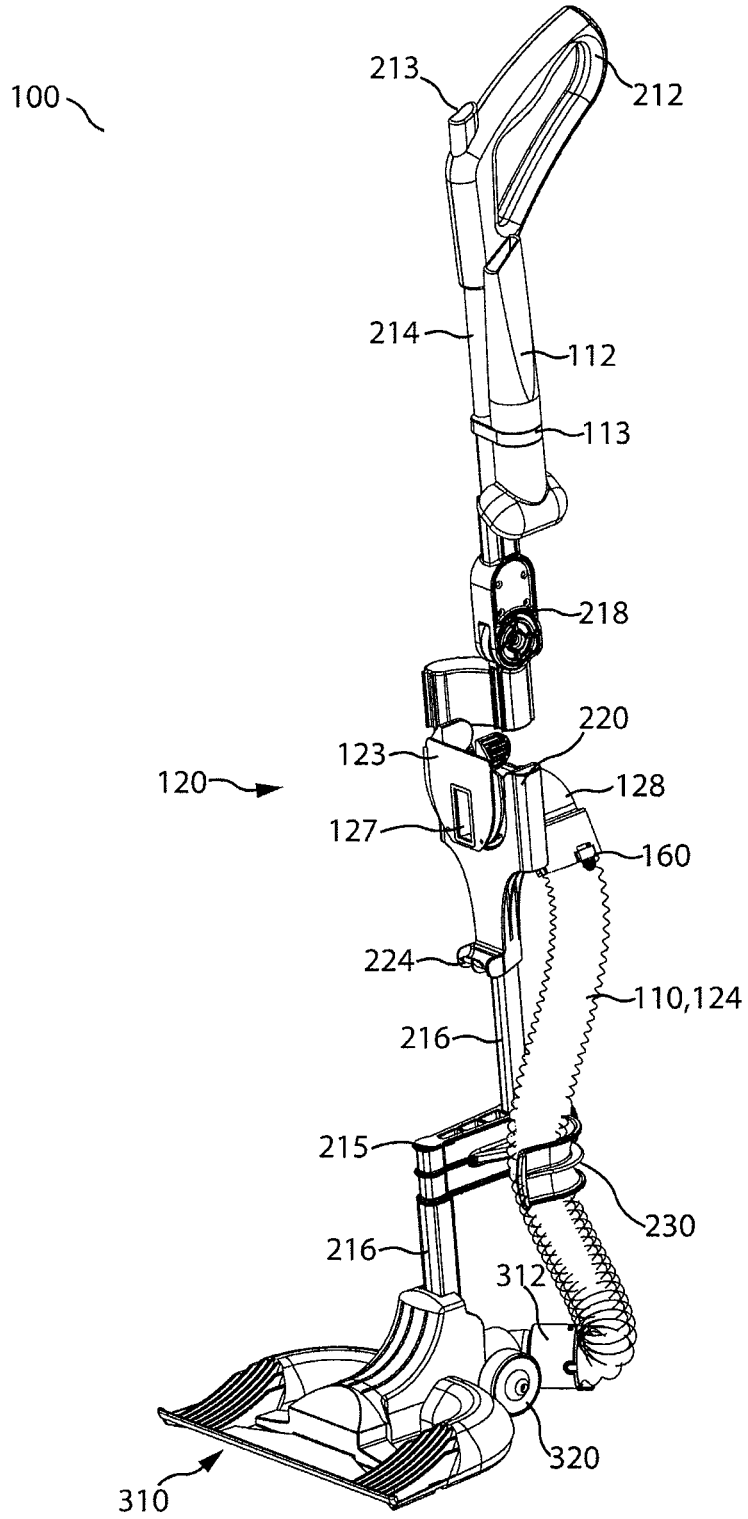
Figure 6:
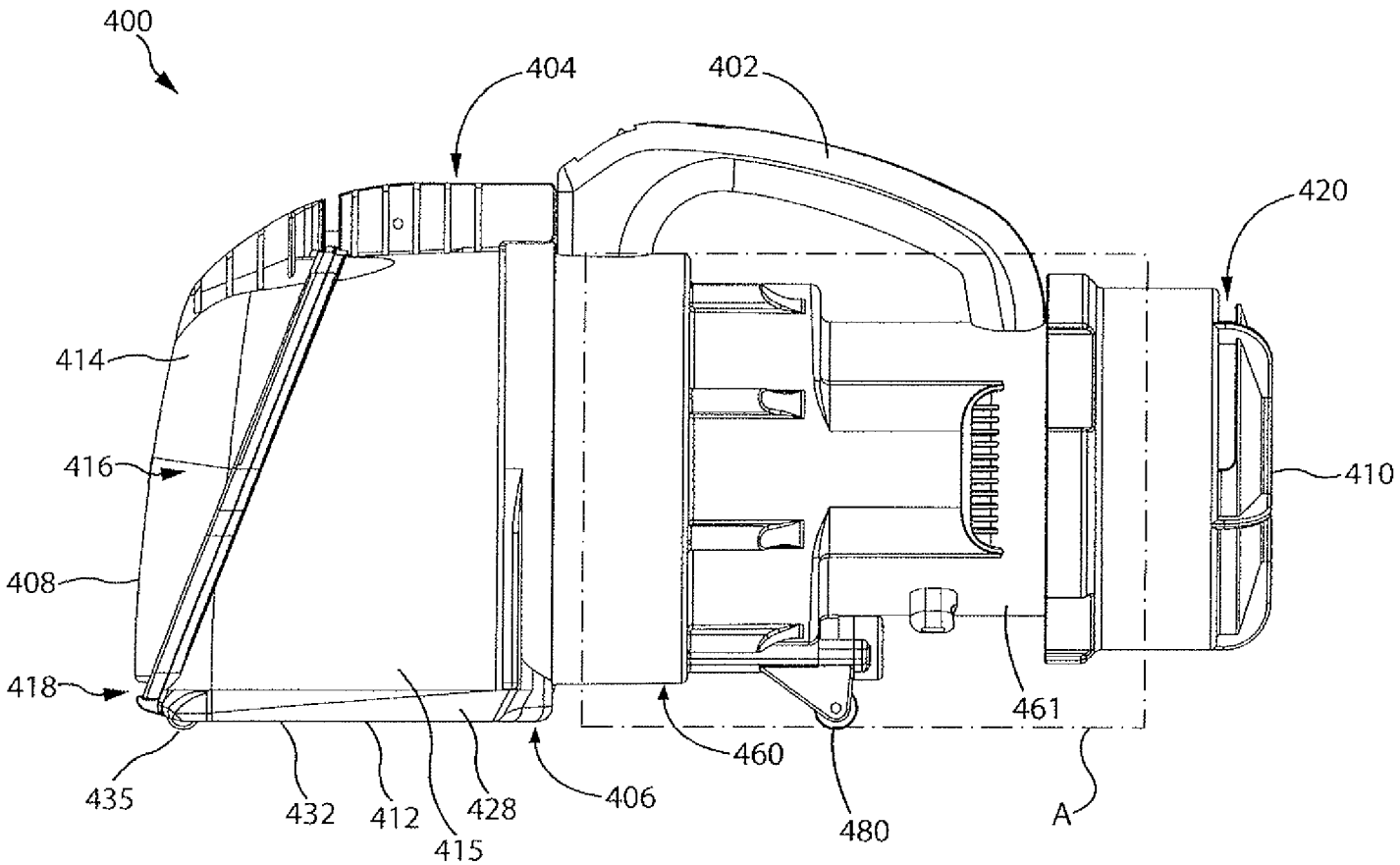
Figure 7:
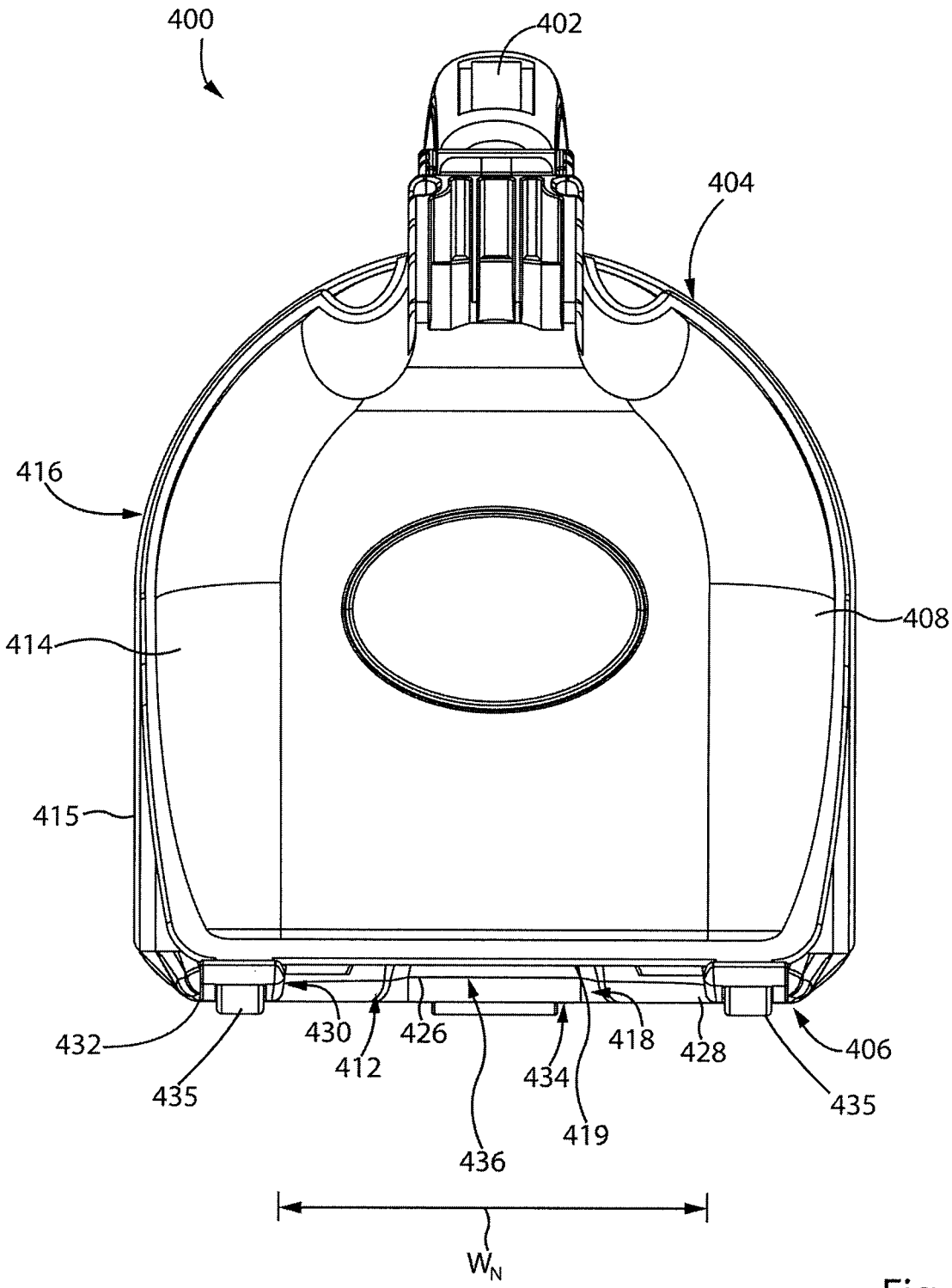
Figure 8:
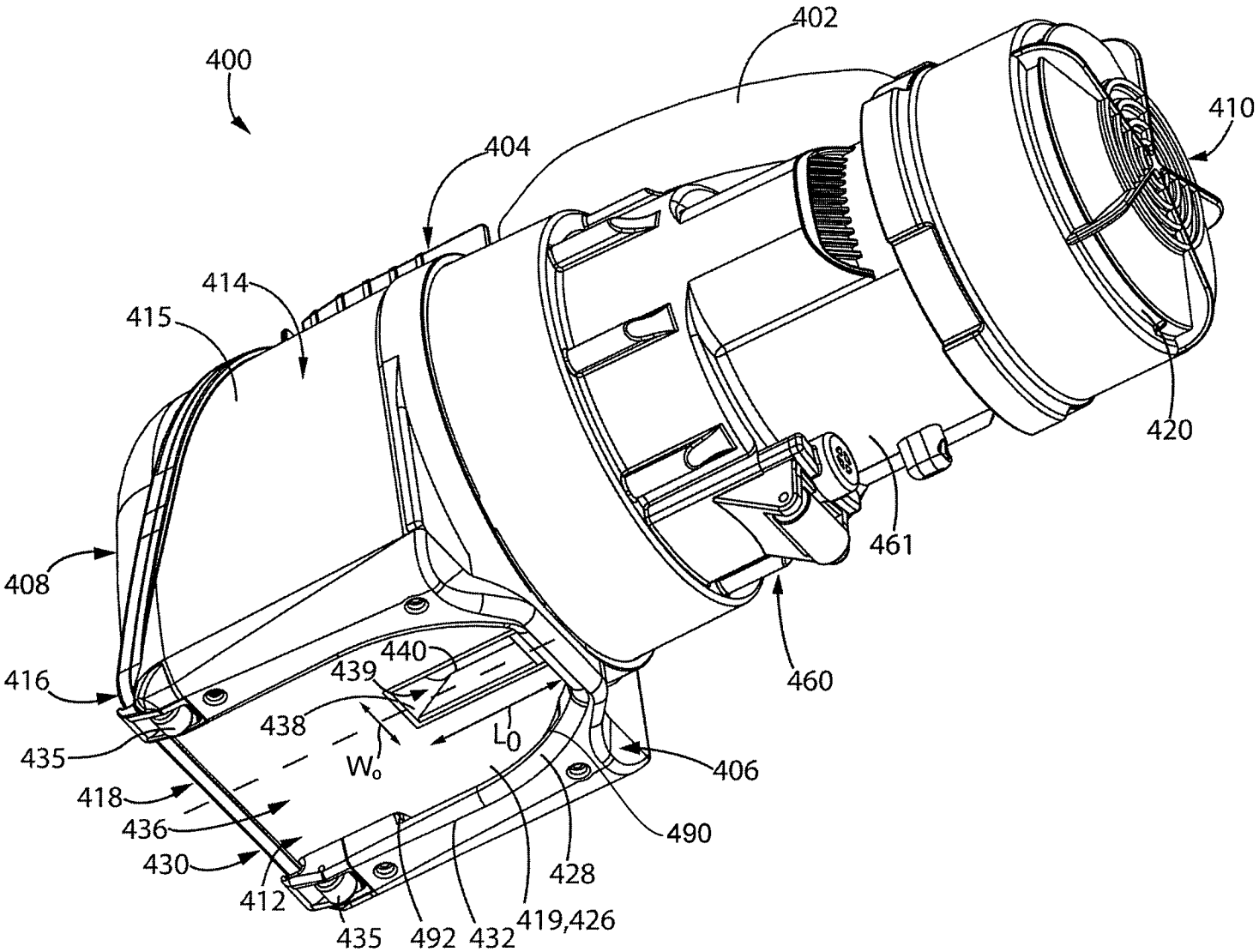
Figure 9:
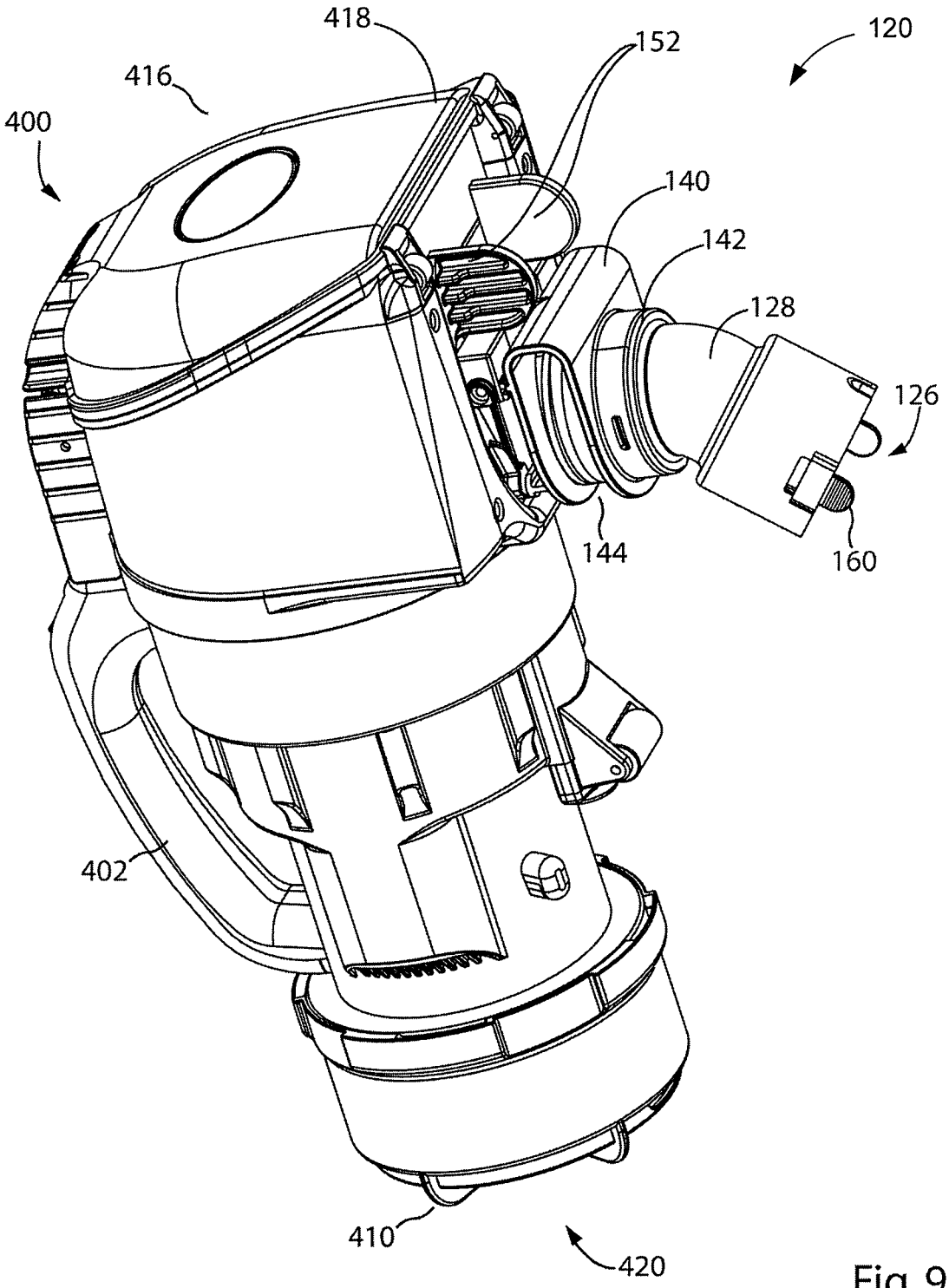
Figure 10:
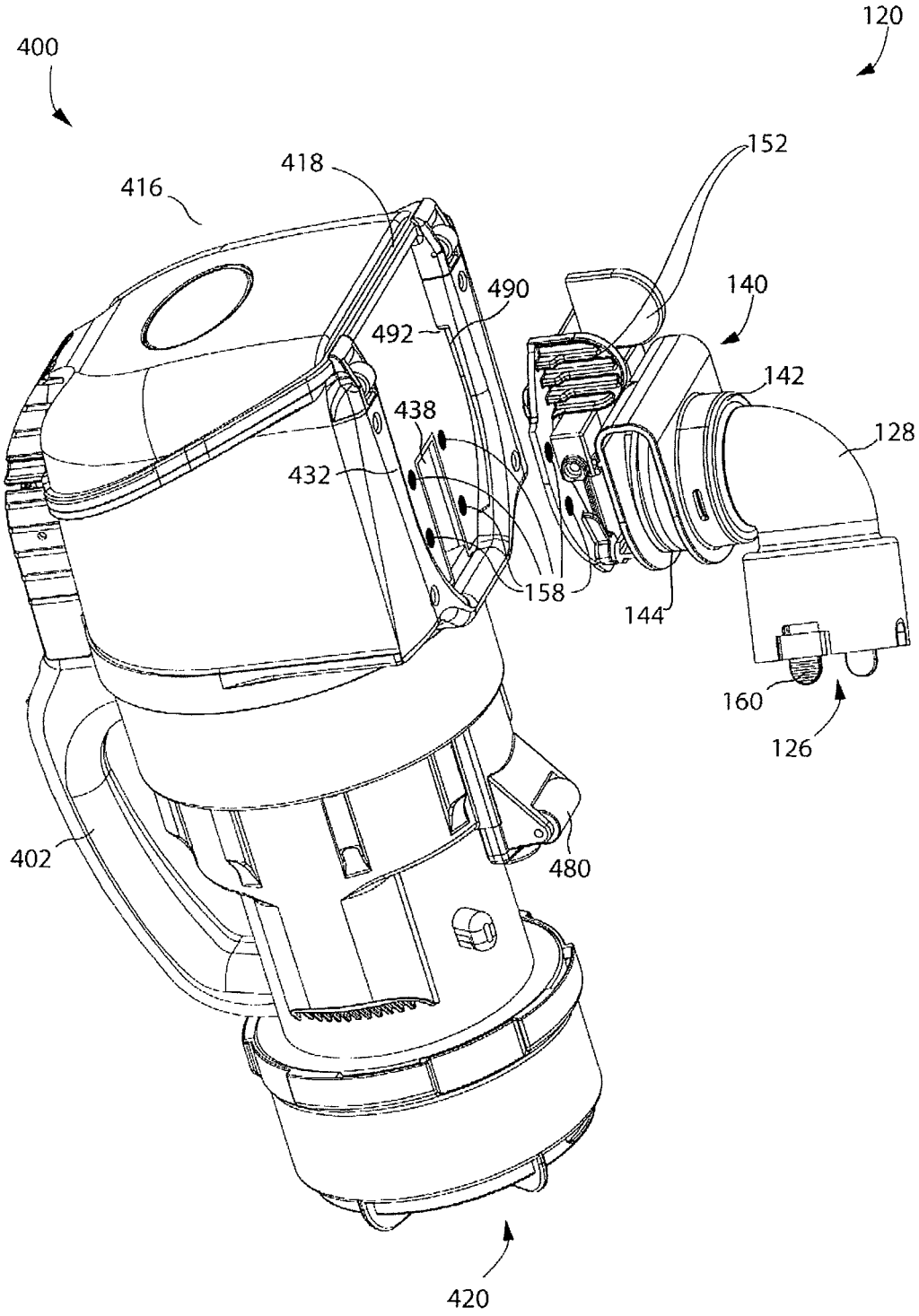
Figure 11:
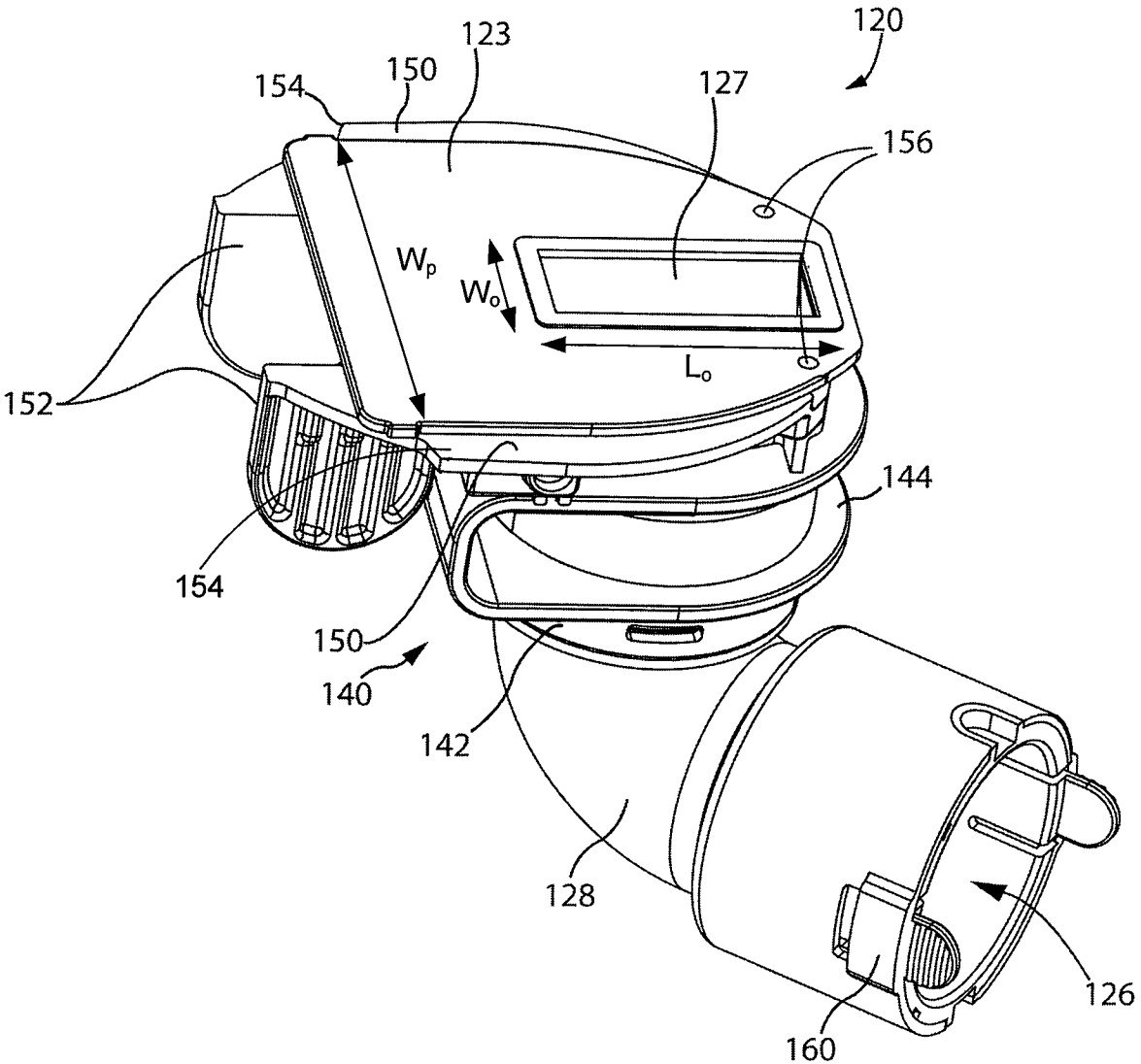
Figure 12:
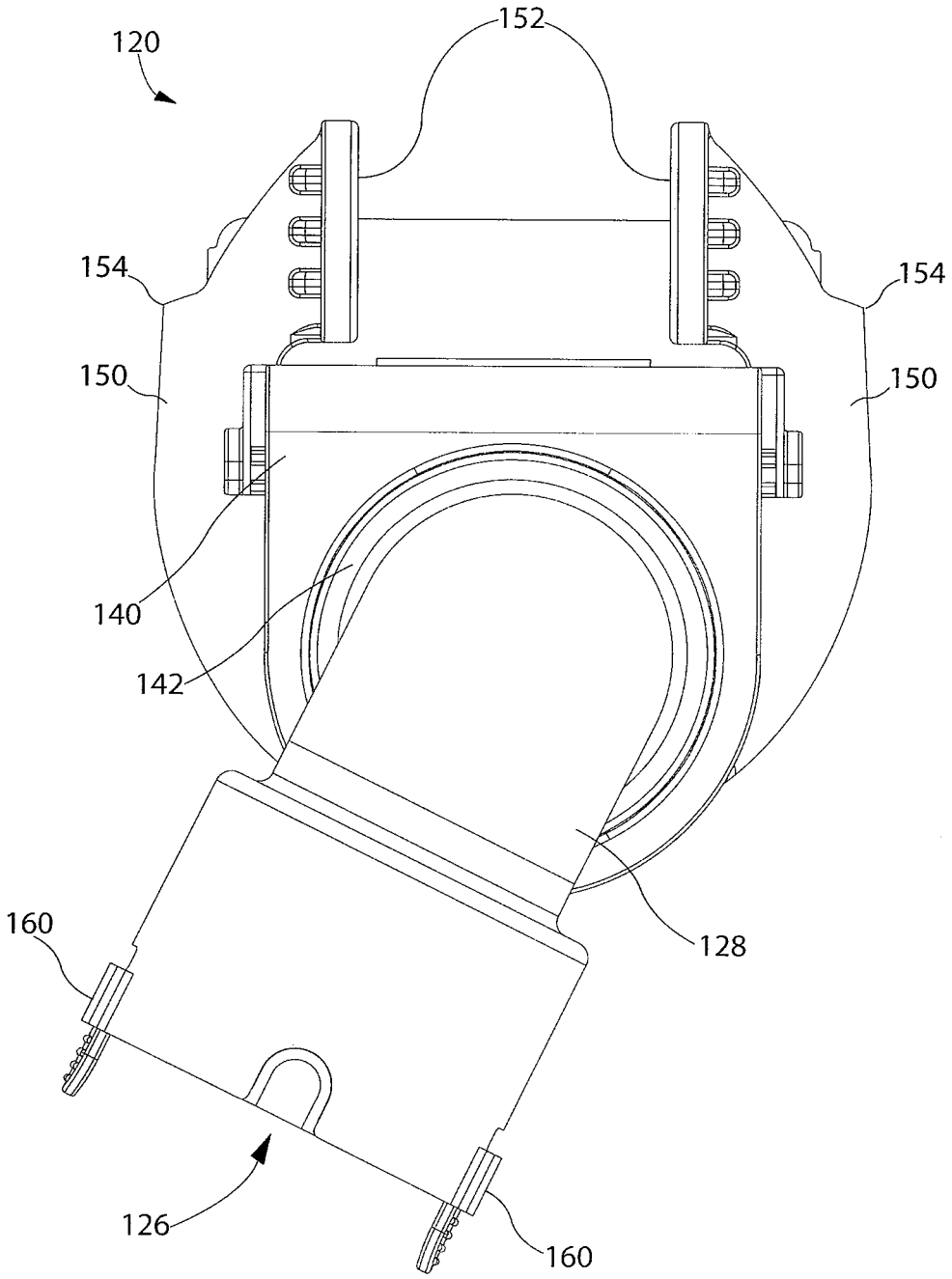
Figure 13:
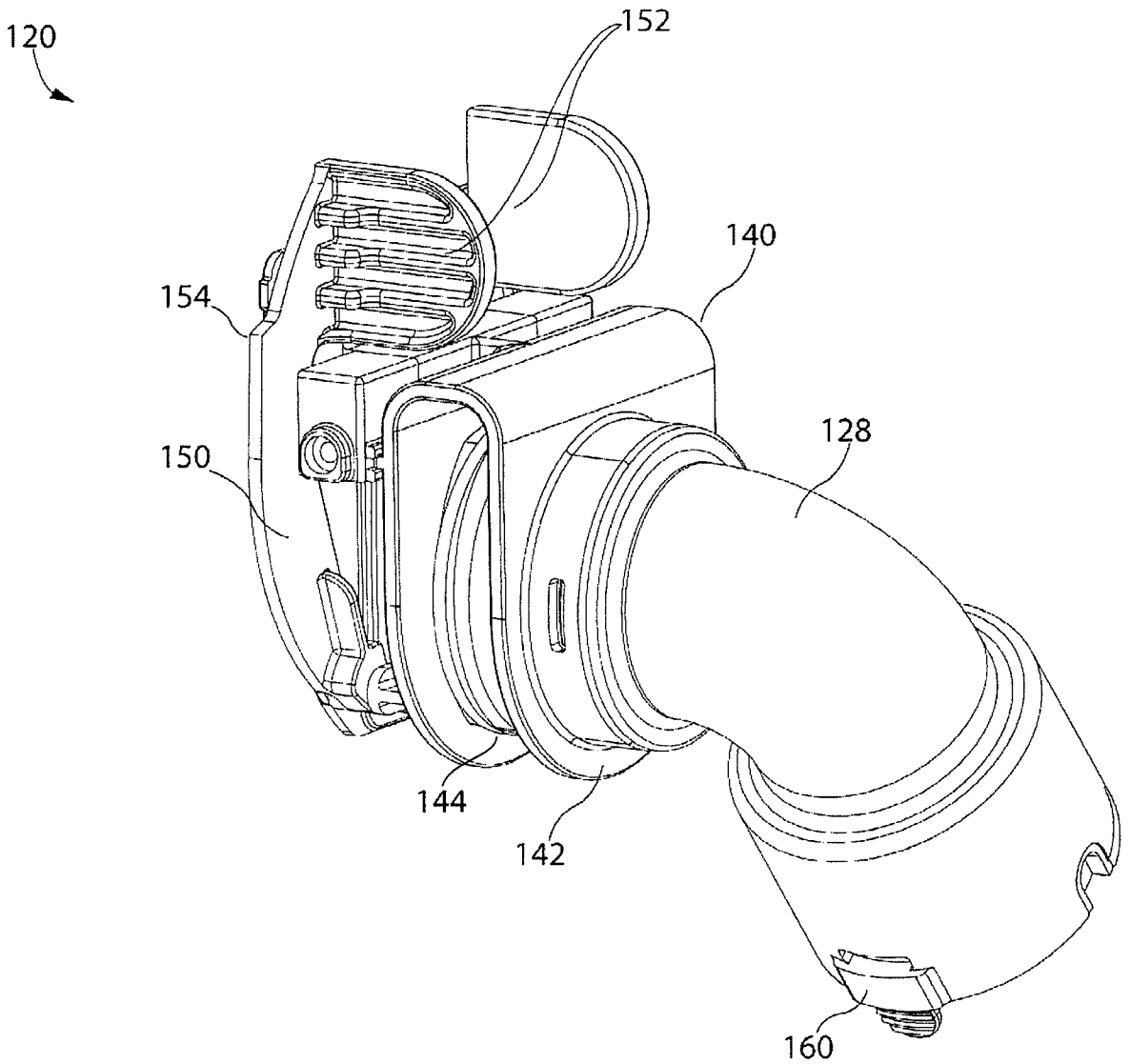
Figure 14:
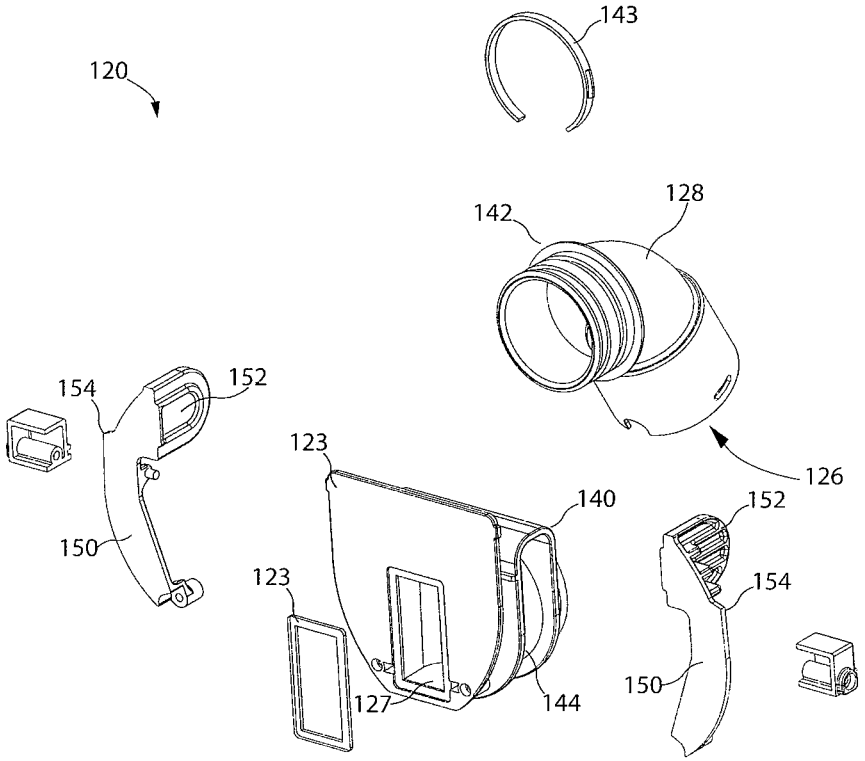
Figure 15:
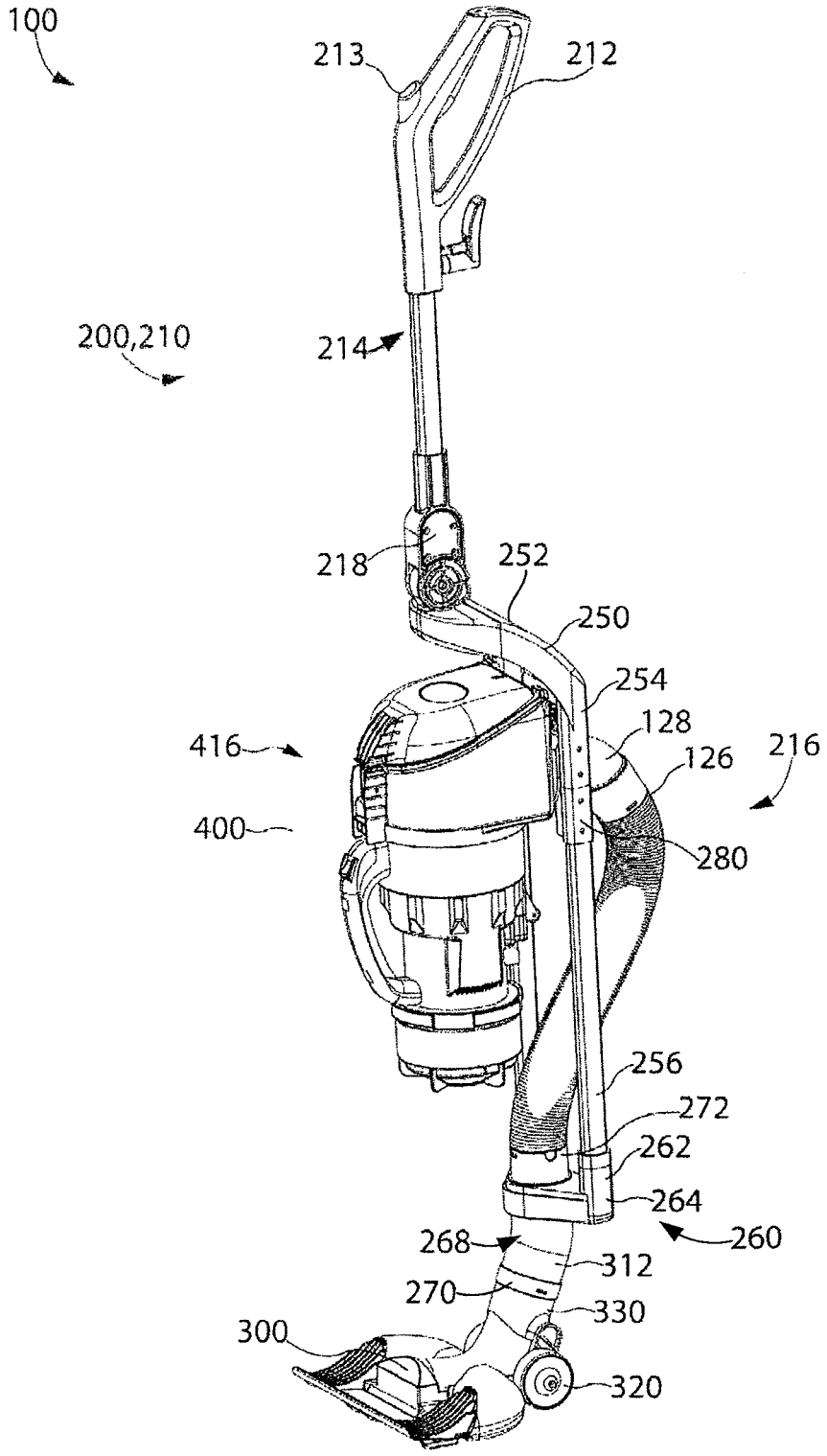
Figure 16:
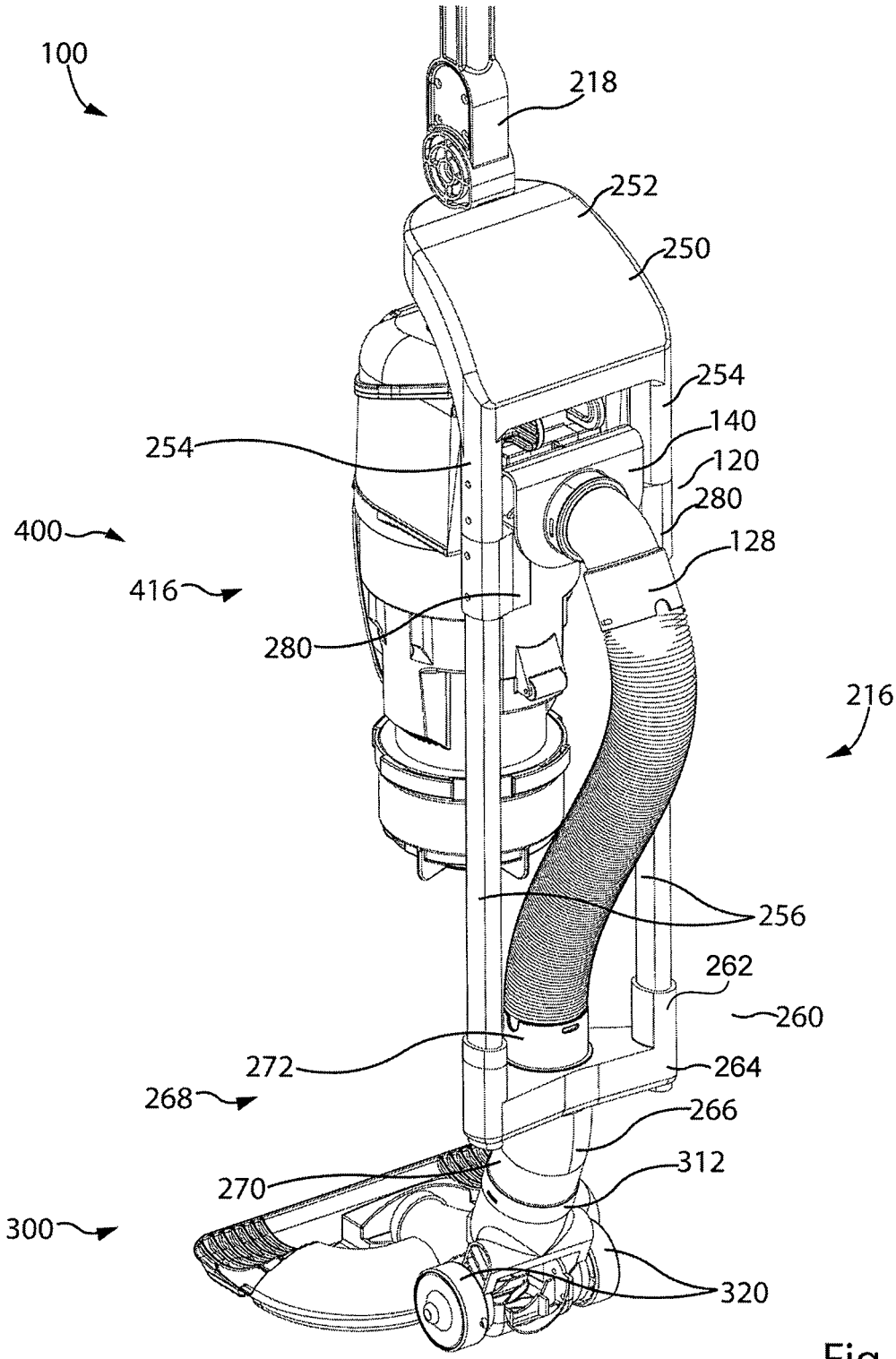
Figure 17:
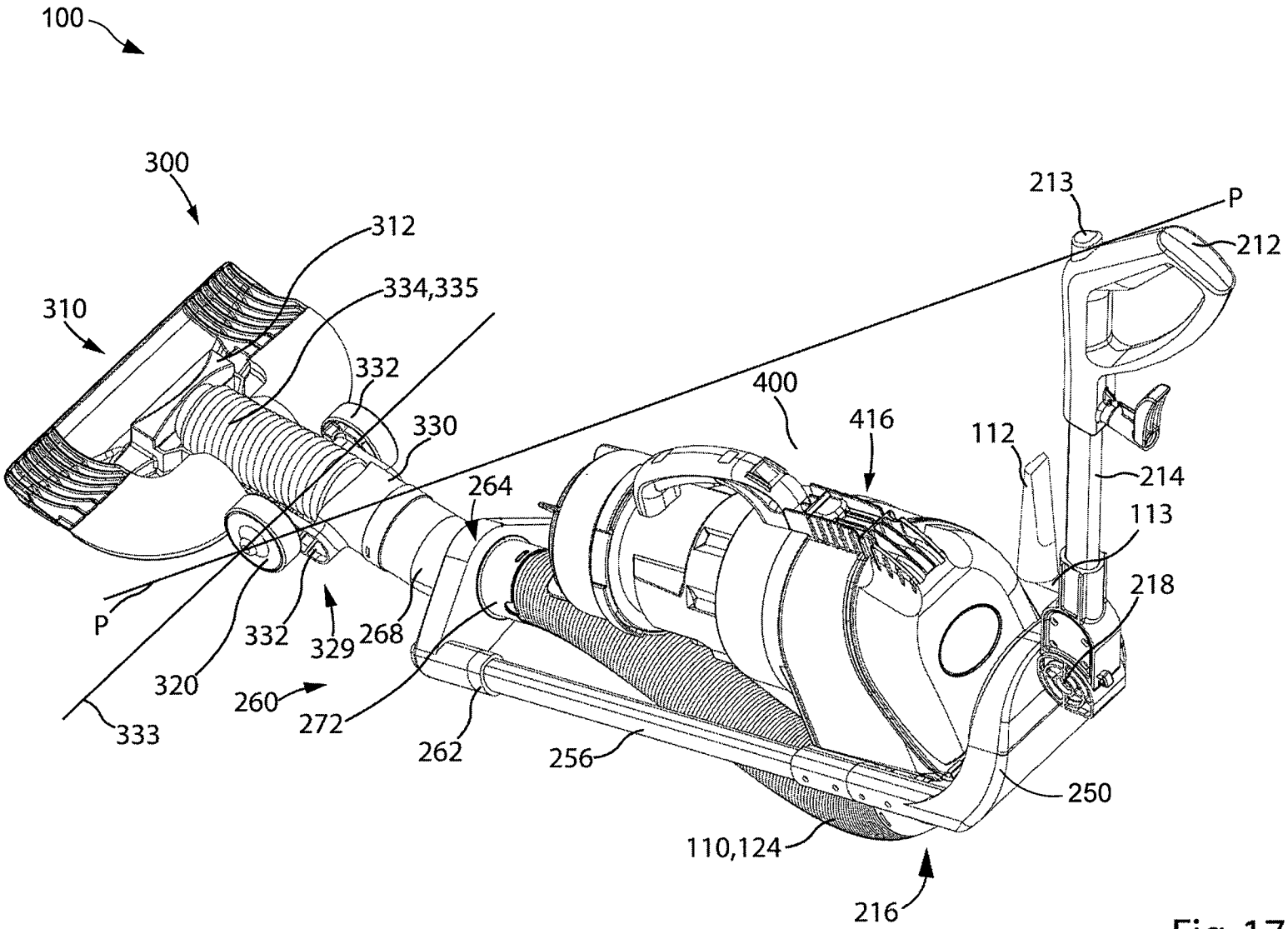
Figure 18:
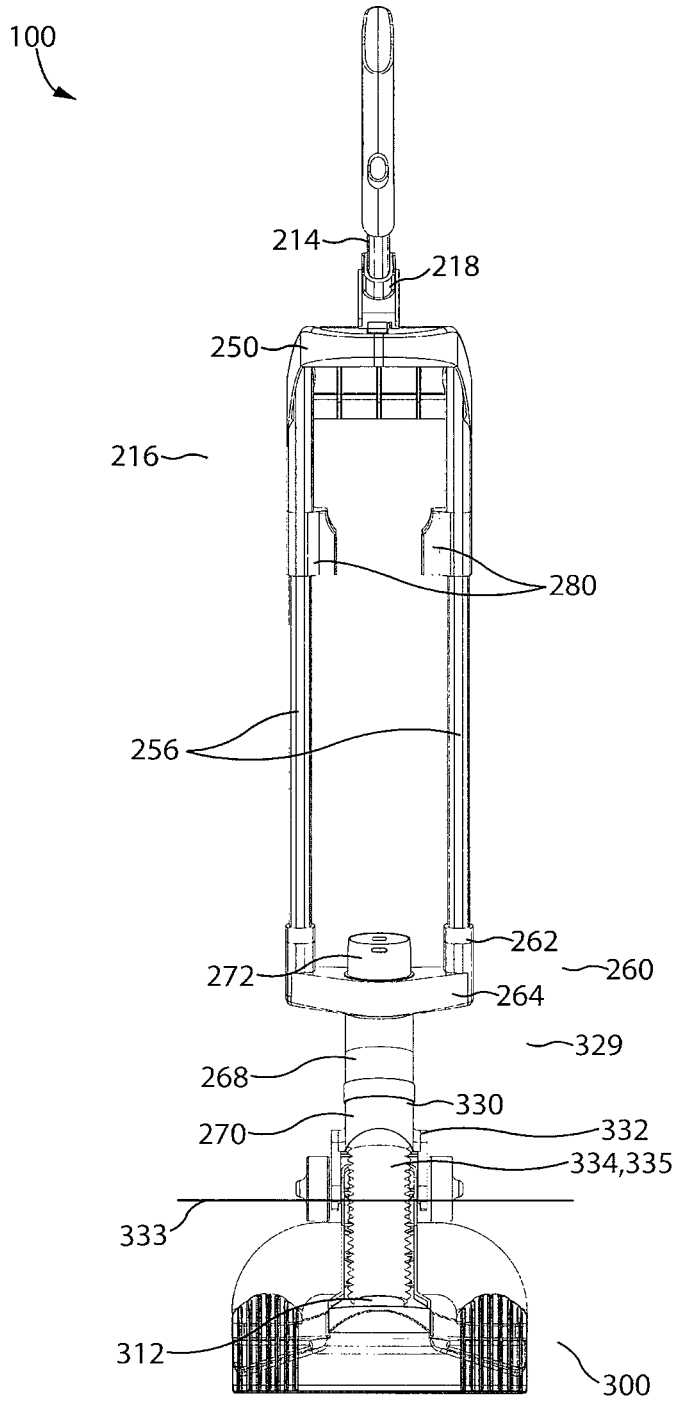
Figure 19:
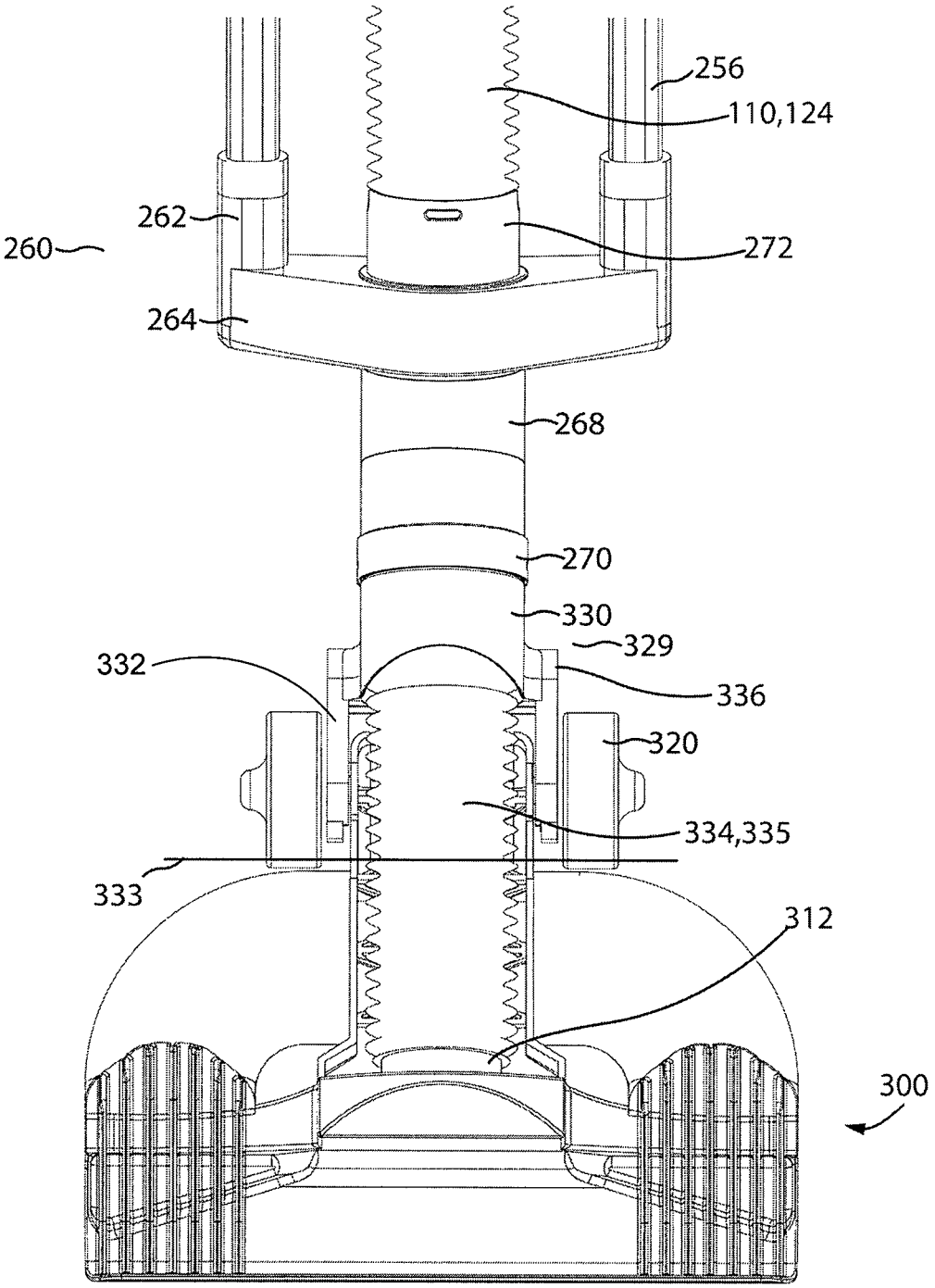
Figure 20:
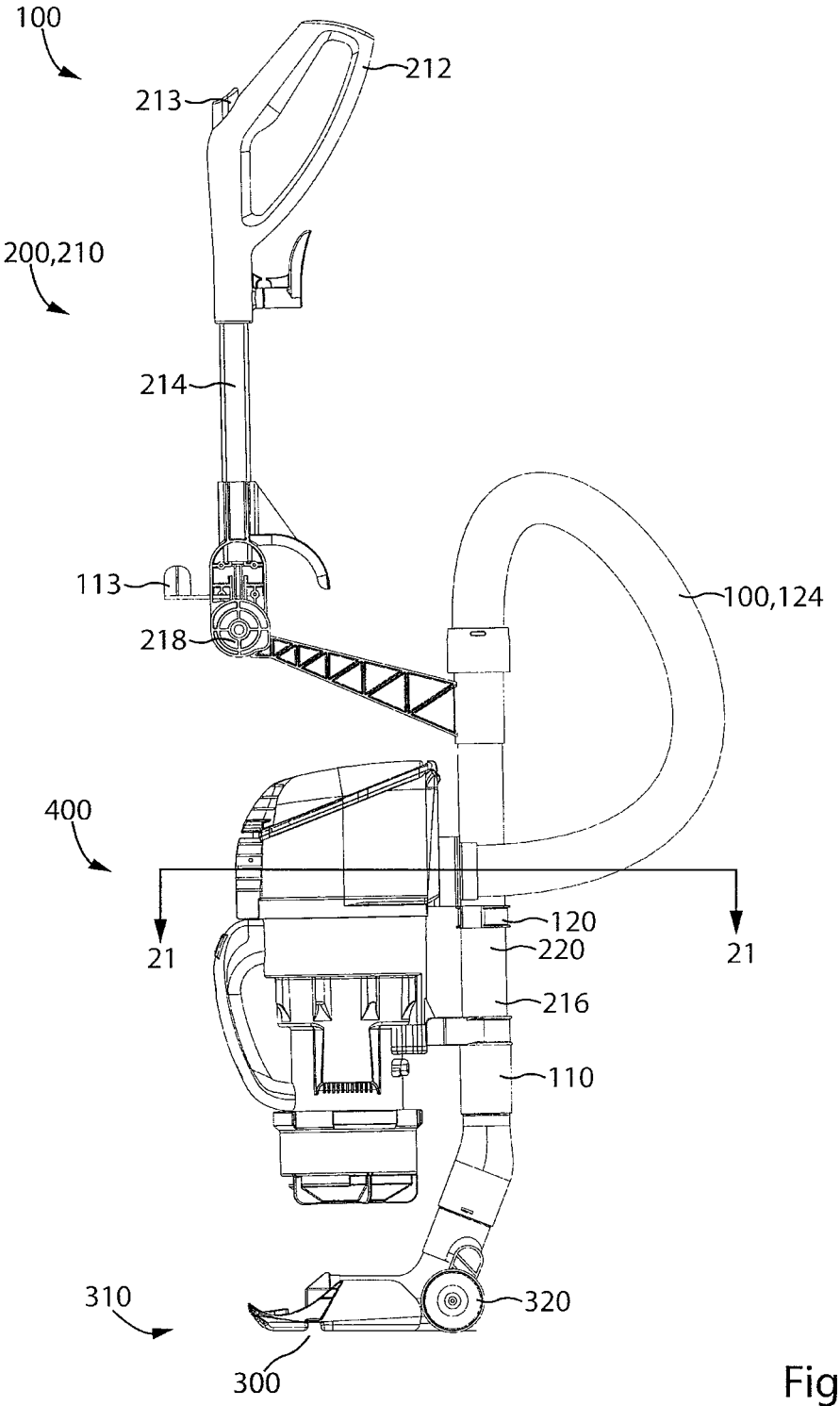
Figure 21:
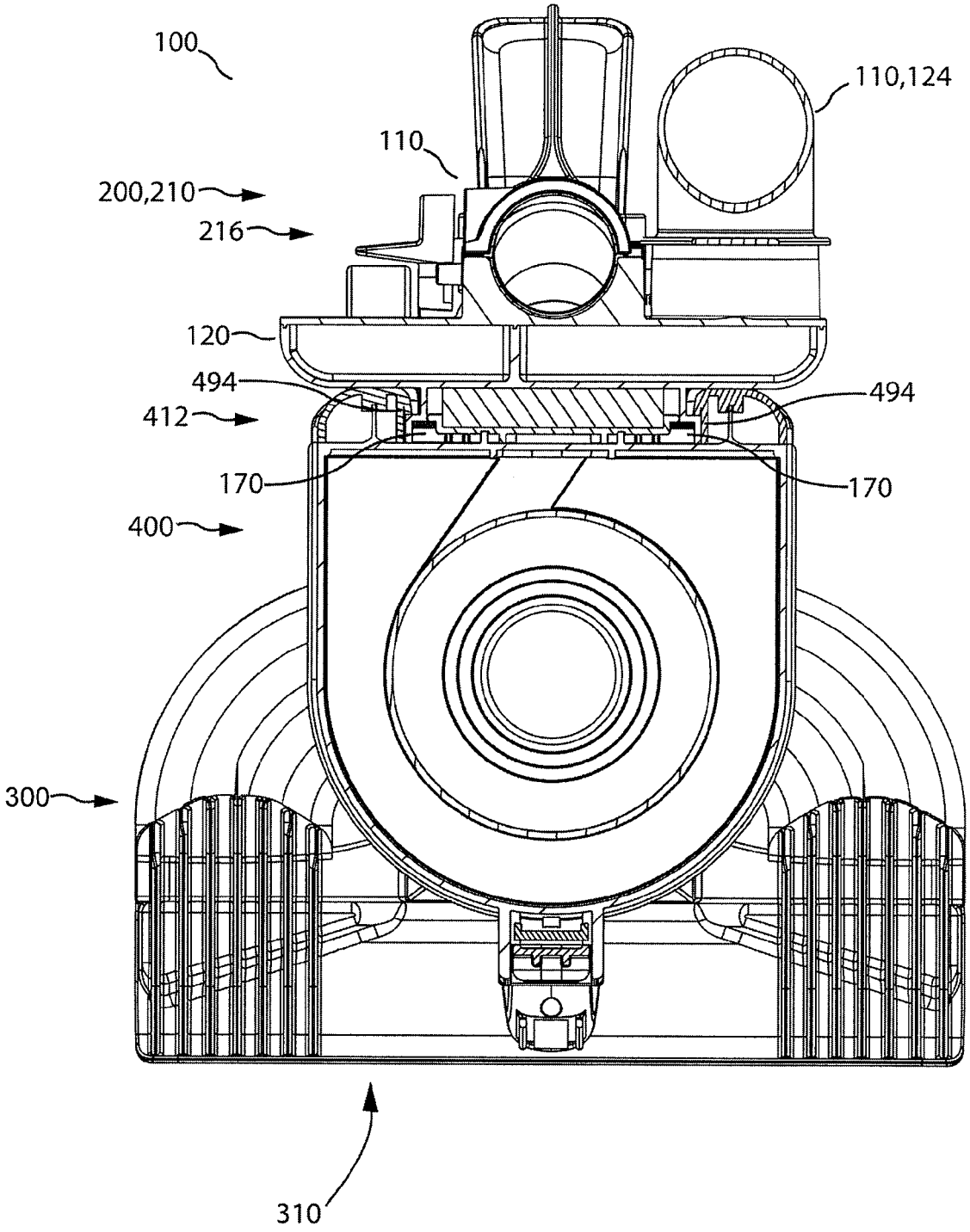
Figure 22:
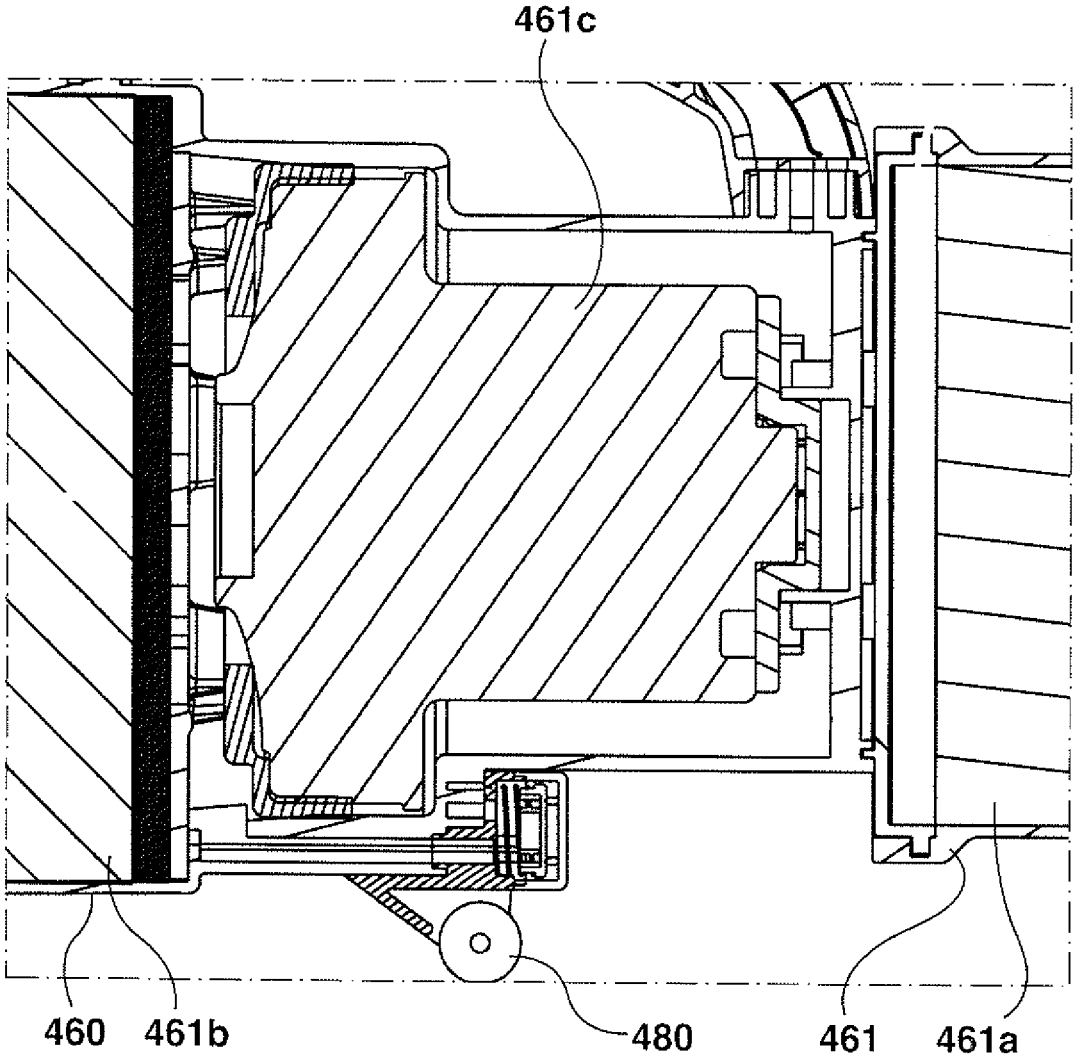

FIG. 3*a* is a back perspective view of the vacuum cleaner of FIG. 1 with the portable surface cleaning apparatus removed from the support structure and in a position in which it may be carried by hand;

FIG. 3*b* is a side elevation view of the portable surface cleaning apparatus of FIG. 3*a* wherein the portable surface cleaning apparatus has been removed from the support structure and is in a position in which it may be carried by hand with flexible hose detached from the surface cleaning head;

FIG. 4 is a partially exploded side perspective view of the vacuum cleaner of FIG. 1 with the portable surface cleaning apparatus removed from air flow communication with the floor cleaning unit;

FIG. 5 is a front isometric view of the vacuum cleaner of FIG. 1 with the portable surface cleaning apparatus removed;

FIG. 6 is side elevation view of a hand vacuum cleaner;

FIG. 7 is a front elevation view of the hand vacuum cleaner of FIG. 6;

FIG. 8 is a bottom isometric view the hand vacuum cleaner of FIG. 6;

FIG. 9 is a bottom isometric view of the hand vacuum cleaner and an attachment member;

FIG. 10 is a partially exploded bottom isometric view of the hand vacuum cleaner and an attachment member of FIG. 9;

FIG. 11 is a side isometric view of the attachment member of FIG. 9;

FIG. 12 is a front elevation view of the attachment member of FIG. 11;

FIG. 13 is a side isometric view of the attachment member of FIG. 11;

FIG. 14 is a partially exploded isometric view of the attachment member of FIG. 11;

FIG. 15 is a front isometric view of an alternate example of a vacuum cleaner with a portable surface cleaning apparatus mounted thereto;

FIG. 16 is a partial rear isometric view of the vacuum cleaner of FIG. 15;

FIG. 17 is a rear isometric view of an alternate example of a vacuum cleaner with a portable surface cleaning apparatus mounted thereto;

FIG. 18 is a partial front isometric view of the vacuum cleaner of FIG. 17 with the portable surface cleaning apparatus removed;

FIG. 19 is a partial top view of the surface cleaning head of the vacuum cleaner of FIG. 17;

FIG. 20 is a side elevation view of an alternate example of a vacuum cleaner with a portable surface cleaning apparatus mounted thereto;

FIG. 21 is a cross-section view of the vacuum cleaner of FIG. 20; and,

FIG. 22 is a cross-section of area A of FIG. 6.

DESCRIPTION OF VARIOUS EXAMPLES

Various apparatuses or methods will be described below to provide an example of each claimed invention. No example described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention. It will be appreciated that each of the features may be used individually or in combination with any one or more other feature.

FIGS. 1-5 exemplify one example of an upright vacuum cleaner having a removably mounted portable surface cleaning apparatus, optionally a hand vacuum cleaner, wherein the portable surface cleaning apparatus has a nozzle having an open sided air flow chamber. It will be appreciated that the portable surface cleaning apparatus may be of any construction and may use any particular air treatment member (e.g., one or more cyclones comprising one or more cyclonic cleaning stages and/or one or more filters). It will also be appreciated that the upright structure to which the portable surface cleaning apparatus is removably attached may be of any particular design. Further, the floor cleaning unit may alternately, or in addition, use an open sided nozzle and may selectively receive an auxiliary cleaning tool.

Referring to FIGS. 1 to 5, a first example of a surface cleaning apparatus 100 is shown. The surface cleaning apparatus 100 is a vacuum cleaner that comprises a floor cleaning unit 200 comprising a surface cleaning head 300 having a support structure 210 pivotally mounted thereto and a portable surface cleaning apparatus or surface cleaning unit 400 that may be removably mounted to support structure 210. Support structure 210 may also be referred to as a handle, a backbone or an upright section.

In the example shown, the handle 210 has an upper portion 214 and a lower portion 216 that are optionally pivotally connected by a hinge 218. The handle 210 is attached to the surface cleaning head 300 and a user can move the surface cleaning head 300 along a surface to be cleaned by gripping and maneuvering the handle 210. Optionally, the lower portion 216 of the handle 210 can be hingedly or pivotally attached to the surface cleaning head 300, so that the lower portion 216 of the handle 210 can move relative to the surface cleaning head 300 during use. This may enable the user to move the surface cleaning head 300 beneath cabinets, furniture or other obstacles.

The upper portion 214 of the handle optionally includes a grip 212 that is shaped to be gripped by a user. In the example shown, the grip 212 is at the top, or upper end of the upper portion 214 of the handle 210 and is formed in a closed loop-type shape having surfaces that are rounded to increase user comfort. In other examples, the grip 212 may be of a different configuration or may be located at a different position on the upper portion 214 of the handle 210.

In addition to the grip 212, the upper portion 214 of the handle 210 optionally includes a bracket 113 that supports an auxiliary, or accessory or supplemental cleaning tool 112. In the example shown, the bracket 113 is configured to hold a single auxiliary cleaning tool 112, but in other examples the bracket 113 may be configured to hold more than one auxiliary cleaning tool 112. Also, while shown attached to the upper portion 214, it is understood that the bracket 113 may be attached to other locations on the surface cleaning apparatus, including the lower portion 216, the surface cleaning head 300 and/or the surface cleaning unit, for example the hand vacuum 400.

In the example shown, the upper and lower portions 214, 216 have a generally cylindrical or tube-like shape. However, in other examples, the upper and lower portions 214, 216 may any other type of thin support members having suitable cross-sectional shape including square, rectangular or polygonal. In addition, the upper and lower portions 214, 216 may be solid or hollow and may be formed from any suitable material, including plastic and metal. In other embodiments, it will be appreciated that handle may be a single unit, e.g., a support rod such that upper and lower portions 214, 216 are part of the same element. Alternately, upright section 210 may comprise a frame for removably receiving a portable surface cleaning apparatus.

The upper and lower portions 214, 216 of the handle 210 are optionally pivotally joined by hinge 218. When the hinge 218 is in a first position, as shown in FIGS. 1, 2, 4 and 5 the upper and lower portions 214, 216 of the handle 210 are generally aligned with each other. The hinge 218 is retained in this first position by a biasing or locking means so that first portion 214 of the handle 210 remains in a generally vertical aligned with lower portion 216 when not in use and so that movements of the first portion 214 of the handle 210 can be translated to the second portion 216. In use, the hinge 218 can be unlocked, or released from the first position and can move into a second position, wherein the grip 212 is preferably rotated forwardly.

In the example shown, the grip 212 comprises a hinge release 213 that can be activated by a user during use of vacuum cleaner 100 to unlock the hinge 218. When a user activates the hinge release 213, the retaining or locking means used to secure the hinge 218 in the first position is disengaged, allowing the hinge 218 to rotate or pivot, as shown in FIG. 3*a*. As the hinge 218 rotates, the first portion 214 of the handle 210 can be moved into a plurality of angular positions relative to the second portion 216 handle 210. Optionally, the hinge 218 may rotate between, and lock into, a given number of set or indexed angular positions. Alternatively, the rotation of the hinge 218 may be continuously variable, after being initially unlocked, allowing for the first portion 214 to be moved into an indefinite number of angular positions relative to the second portion 216 (e.g., freely rotatable).

In the example of the vacuum cleaner 100 shown, the lower portion 214 of the handle 210 extends from the hinge 218 to the surface cleaning head 300 and optionally comprises the portable surface cleaning apparatus mount 220 for receiving and supporting the hand vacuum 400. The lower portion 216 also optionally comprises a hose guide 230 for keeping the flexible hose 124 in close proximity to the backbone 200. When the portable surface cleaning apparatus 400 is detached or removed from the backbone 200 the flexible hose 124 may be removed from the hose guide 230, as shown in FIG. 3*a*.

The surface cleaning head 300 serves as a base portion of the vacuum cleaner 100 and is preferably in rolling contact with the surface to be cleaned. When the vacuum cleaner is 100 in an upright position (as exemplified in FIGS. 1, 2, 4 and 5) the surface cleaning head 300 is supported by optional main or rear wheels 320 and/or optional front wheels (not shown). However, when the vacuum cleaner 100 is moved into an angled position during use (as exemplified in FIG. 3*a*) additional optional support wheel 321 that is provided on upright section 210 may also roll across the surface to be cleaned. In other examples of the vacuum cleaner 100 the surface cleaning head 300 may include a greater or fewer number of wheels.

The surface cleaning head 300 also comprises a dirty air inlet 310 that is connected in fluid communication with a dirty air outlet 312 by one or more dirty air conduits (not shown). Preferably, the dirty air conduit is an air flow chamber wherein at least a portion of the lower side is open.

If the upright section includes a suction motor and/or an air treatment unit, then the dirty air outlet 312 may, in turn, be coupled, optionally removably coupled, to the upstream end of the conduit, preferably a flexible hose 124, that extends from the dirty air outlet 312 of the surface cleaning head 300 to the upright section, such as the attachment member air inlet 126. The fluid pathway may continue through the attachment member passageway 128, which terminates in attachment portion air outlet 127, and through attachment portion air outlet 127 which mates with the opening 438 of the portable cleaning apparatus 400. The connection between the attachment portion 120 and the portable cleaning apparatus 400 is discussed in greater detail below.

In examples where the surface cleaning unit 400 is detachable, mount 220 is preferably configured to removably receive a portion of the portable surface cleaning apparatus and/or an attachment member removably mounted to the portable surface cleaning apparatus. The mount is preferably configured to retain portable surface cleaning apparatus therein under the influence of gravity. Accordingly, a mechanical lock need not be used. In particular, a user may lift the portable surface cleaning apparatus off of upright section 210 without having to press a button or otherwise release a mechanical lock.

As exemplified in FIGS. 1-5 the mount 220 may be generally U-shaped and may be sized to receive collar 140 or other mounting portion of the attachment member 120. The inner surface of the mount 220 comprises a protrusion 222 that extends outward from the inner surface of the mount 220 and removably seats within the generally U-shaped channel 144 of the collar 140. It will be appreciated that mount 220 may comprise more than one member, as exemplified in FIGS. 14-15.

The mount 220 may be located in a variety of locations along the length of the second portion 216. Preferably, the mount 220 is positioned at approximately the waist height of the intended user (e.g., 2.5-3.5 feet above the floor) so that the user can attached or detach the hand vacuum 400 from the backbone 200 without bending over. This may decrease the stress and strain experienced by the user when the user removes the hand vacuum 400 from the backbone 200.

Figure 2:
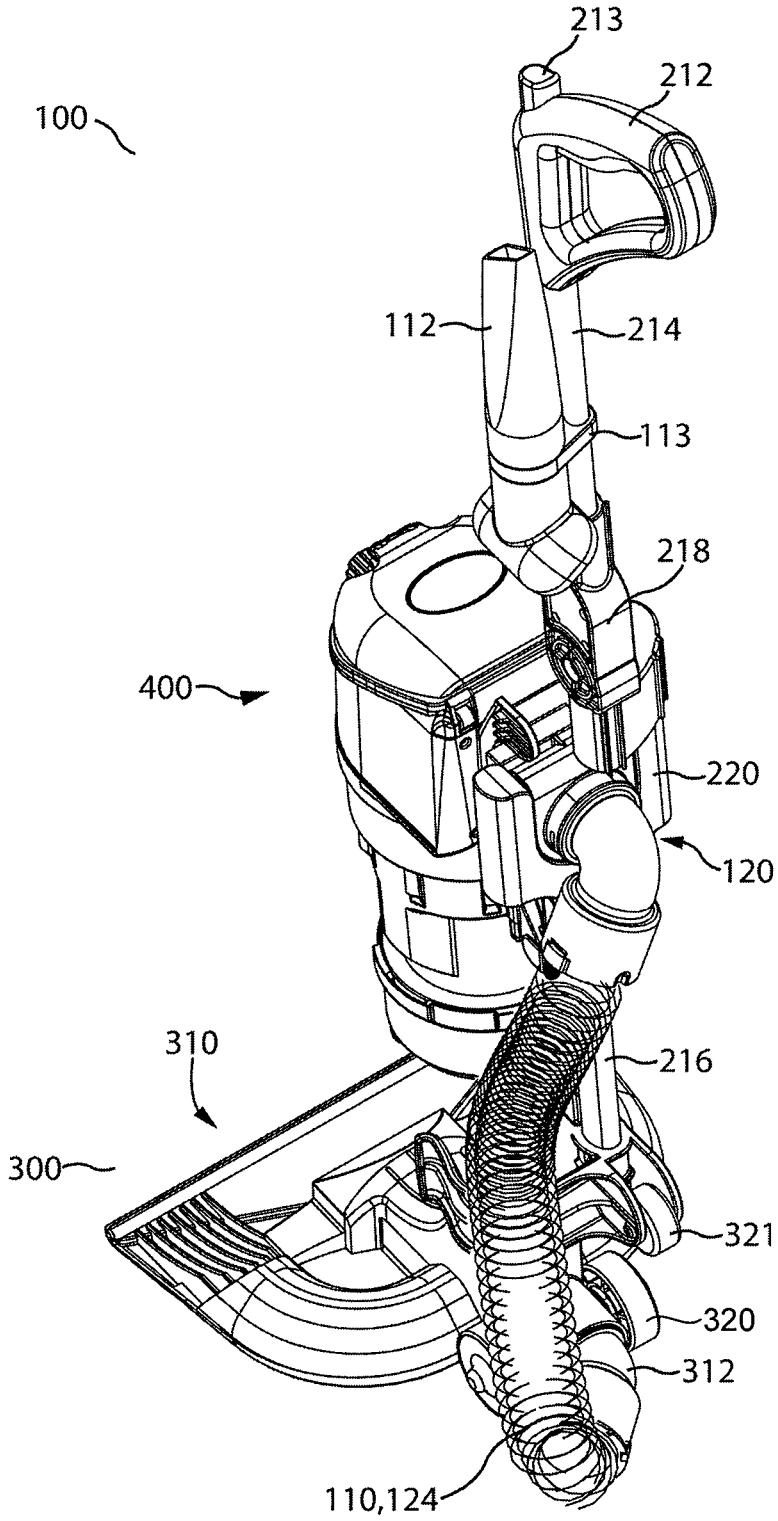
FIG. 2 is a back perspective view of the vacuum cleaner of FIG. 1 with a portable surface cleaning apparatus mounted to a support structure.

When attached to the portable surface cleaning apparatus 400 and seated in the mount 220 (as shown in FIGS. 1 and 2), the attachment member 120 transfers all or a portion of the load (i.e. the weight) of the hand vacuum 400 to the mount 220. Another portion of the load of the hand vacuum 400 may be supported by an additional mounting bracket, such as mount bracket 224, which receives and supports optional rear wheel 480 of the portable surface cleaning apparatus 400. The surface of the mount bracket 224 may be complimentary to the curved shape of the optional rear wheel 480 so that the optional rear wheel 480 can at least partially nest within mount bracket 224. In addition to supporting the weight of the portable surface cleaning apparatus 400, the attachment portion 120 also preferably serves as a fluid conduit establishing a fluid flow connection between the hand vacuum 400 and the airflow conduit 110, which preferably includes a flexible hose 124. In some examples, as exemplified in FIGS. 1-5, the flexible hose 124 may comprise substantially the entire length of the airflow conduit 110 connecting the hand vacuum 400 to the surface cleaning head 300. In other examples, as exemplified in FIG. 20, the flexible hose 124 may comprise only a portion of the airflow conduit 110 and another portion of the airflow conduit 110 may be formed by the lower portion 216 of the backbone 200.

Loads placed on the mount 220 (via both the U-shaped opening and/or the mount bracket 224) are in turn transferred via the lower portion 216 of the handle 210 to the surface cleaning head 300 and ultimately to the floor or other type of surface being cleaned. The mount 220 may be made from any material that can support the weight of the hand vacuum 400, including plastic and metal.

In the example of the vacuum cleaner 100 shown, the optional rear wheel 480 of hand vacuum 400 and the attachment member 120 are each preferably freely received by the mount 220 and held in place by gravity. The protrusion 222 that seats within the channel 144 of the attachment member 120 also provides a degree of lateral support, restraining the movement of the attachment member 120 (and therefore the hand vacuum 400) when the handle 210 is moved from a vertical position to an angled position when in use. Further protrusion 222 may comprise a cam surface to assist in guiding protrusion 222 into channel 144 as the portable surface cleaning apparatus is lowered onto mount 220. Accordingly, the attachment member 120 and the optional rear wheel 480 are preferably not held in place by clips, straps or any other type of mechanical fastening means.

The absence of mechanical fasters allows for simple, one-handed removal of the attachment member 120 and the hand vacuum 400 from the mount 220, without the need to unlock or undo any fasteners. One-handed detachment of the hand vacuum 400 may be advantageous as it allows a user to control and maneuver the backbone 200 with one hand while simultaneously removing the hand vacuum 400 from the mount 220 with the other hand. In use, this may allow a user to frequently attach and detach the portable surface cleaning apparatus 400 from the mount 220 in response to the user's needs, for example navigating around furniture, stairs or other obstacles on the surface to be cleaned.

While in the preferred example described above the mount 220 is free of fasteners, in another example the mount 220 may be outfitted with fastening devices for retaining the attachment member 120 and the additional wheel 480. Examples of possible fasteners include clips, snaps, and straps. Magnets may alternately or in addition be used. An advantage of using magnets may assist in holding the portable surface cleaning apparatus on the backbone but still permit one handed removal as no lock need be released.

In some examples of a surface cleaning apparatus, as exemplified in FIGS. 1-19, the portable surface cleaning apparatus 400 is fastened to the attachment member 120 and the attachment member 120 is seated on the mount 220 without the use of mechanical fasteners (i.e. it is gravity mounted). In these examples, when a user grabs the portable surface cleaning apparatus 400 attachment member 120 remains attached to the nozzle 412 and is freely removed from the mount 220 allowing for quick and easy detachment of the portable surface cleaning apparatus 400 from the support structure. As described in more detail below, the portable surface cleaning apparatus 400 may be detached from the attachment member 120 by the user if necessary.

In other examples, as exemplified in FIGS. 20 and 21, the attachment member 120 may be connected to the mount 220 using a mechanical fastening means and the nozzle 412 of the portable surface cleaning apparatus 400 may be freely seated upon, or gravity mounted on, the attachment member 120. In this example, the connection between the portable surface cleaning apparatus 400 and the attachment member 120 may be a slidable connection means, such as a complimentary tongue and groove arrangement. In this example, the portable surface cleaning apparatus 400 is still freely removable from the support structure 210, without the need to release or detach any fastening devices, but when the portable surface cleaning apparatus 400 is removed the attachment member 120 remains connected to the support structure 210. If a user wishes to remove the portable surface cleaning apparatus 400 from the support structure 210 while maintaining the airflow connection to the surface cleaning head 300, the user may release the attachment member 120 from the mount 220 thereby maintaining the airflow connection to the surface cleaning head 300 while the portable surface cleaning apparatus 400 is detached.

In all examples of the surface cleaning apparatus 100 that include a detachable portable surface cleaning apparatus, it is possible for the user to detach the portable surface cleaning apparatus from the support structure without having to release any mechanical fasteners. In addition, in all examples of the surface cleaning apparatus 100 that include a detachable portable surface cleaning apparatus, it is possible for the portable surface cleaning apparatus to remain in airflow communication with the surface cleaning head 300 when detached, and optionally to be operably disconnected from the portable surface cleaning apparatus and used as a stand alone cleaning device.

Optionally, instead of removing the attachment portion 120 from the mount 220, the hand vacuum 400 may be decoupled from the attachment portion while the attachment portion is positioned in mount 220, as shown in FIG. 5. In an embodiment, it will be appreciated that attachment member 120 may not be removable from mount 220.

Referring to FIGS. 15-19, other examples of the vacuum cleaner 100 are shown. These figures exemplify features of a surface cleaning apparatus that may be used with any embodiment disclosed in herein, either individually or in any particular combination or sub-combination. The features exemplified in these figures include a surface cleaning head, a support structure for an upright or stick vacuum cleaner, and a handle mount for a surface cleaning apparatus.

In this description, an alternate structure for supporting an air treatment unit and/or a suction motor is provided. As exemplified, the second portion 216 may include a generally upside down U-shaped wishbone portion 250. The wishbone 250 is optionally provided with a hinge 218 at the centre of an upper portion of the wishbone 252, and each prong 254 of the wishbone extends downward, and connects to a rib 256. The ribs 256 are preferably substantially parallel and cooperate to define an optional mount for receiving a removable surface cleaning unit, such as the split saddle configuration that is exemplified. Optionally, the ribs 256 may be integrally formed with the prongs 254 of the wishbone portion 250, or they may be separate tubes or rods fastened to the prongs 254 of the wishbone 250, as shown.

A preferred mount comprises a pair of generally opposing saddle flanges 280 (one on each rib) that cooperate to provide a mount or a mounting location for the attachment member 120 that is connected to the hand vacuum 400. Due to the spacing of the ribs 256 and the general curvature of the hand vacuum 400, the hand vacuum 400 is preferably positioned in front of ribs 256. The attachment member 120 extends rearward of hand vacuum 400 and may be received on split saddle flanges 280 in a similar manner to mount 220. Alternately, it will be appreciated that hand vacuum 400 may be partially nest between, or be received between, the ribs 256.

As exemplified, to supportingly engage the attachment member 120, each saddle flange 280 preferably includes a projection or protrusion (not shown) that is received within the channel 142 of the collar 140 (as described in more detail with reference to FIGS. 11-14 below). The generally curved profile of the collar 140 and channel 142 may enable the attachment member 120 (and the associated hand vacuum 400) to generally self-level or self-register between the ribs 256 when the user initially places the attachment member 120 on the saddle flanges 280. Like the mount 220 described above, the saddle flanges 280 may include magnets or other fastening devices to secure or retain the attachment member 120. Optionally, the mount 220 or any other suitable type of mounting hardware may replace the saddle flanges 280 in this example.

The lower ends of the ribs 256 may be attached to a bracket 260 having a generally opposite configuration than the wishbone. That is, the bracket may include two, upward facing projections 262, for attaching to the ribs 256, that are connected by a cross-member 264 to provide a single downward facing coupling point 266. The spaced apart ribs provide two mounting points. Various of such structure may be used.

Preferably, lower portion 216 is rotatably mounted to the cleaning head. Accordingly, a user may rotate grip 212 clockwise or counterclockwise to assist in steering the cleaning head. Accordingly an advantage of providing a single, downward facing coupling point may be the fact that a single coupling point can be pivotally and rotationally connected to the surface cleaning head 300. Another advantage is that a narrower rear end may be utilized for the floor cleaning unit.

Accordingly, as exemplified, the bracket 260 preferably also includes a housing 268, which is preferably hollow, having a lower opening 270 that connects to the surface cleaning head 300. As exemplified, housing 268 may be pivotally mounted to surface cleaning head, preferably at about the location of rear wheels 320, such as by having a portion pivotally mounted to the axle of rear wheels 320. Optionally, the connection between the lower opening 270 and the surface cleaning head 300 can be a rotatable and pivotal connection. The hollow housing 268 may extend from the lower opening 270, through the cross-member 264 to define an upper collar 272.

Optionally, as in this example, the surface cleaning head 300 includes a pivot mount 329 for pivotally connecting the surface cleaning head 300 to the backbone or support structure 200. The pivot mount 329 may comprise a hollow conduit member 330 that defines an interior passage extending through at least a portion of the pivot mount 320. The pivot mount 329 may also comprise two, downwardly extending arms 332 that are pivotally connected to the surface cleaning head 300 using any suitable moveable connection, including pins, bolts, rivets and axels.

The pivot mount 329 is pivotally connected to the surface cleaning head 300 so that it can pivot about a pivot mount axis 333 passing through the surface cleaning head 300. In some examples, the pivot mount axis 333 is coincident and coaxial with the rotation axis of the rear wheels 320. As exemplified in FIGS. 17-19, the pivot mount 329 may be pivotally connected to the axle(s) that connects the rear wheels 320 to the surface cleaning head 300.

In another example of the surface cleaning apparatus 100, the pivot mount axis may be different than, and offset from the rotation axis of the rear wheels 320. Preferably, the pivot mount axis is located at least as rearward on the surface cleaning head 300 as an axel for the rear wheels 320.

The hollow conduit member 330 of pivot mount 329 may receive a portion of the air conduit 110 that connects the dirty air inlet 310 to the clean air outlet 420. As exemplified in FIGS. 17-19, the airflow conduit 110 connecting the surface cleaning head 300 to the hand vacuum or surface cleaning unit 400 may comprise a second air conduit 334. The second air conduit 334 may also be referred to as the upstream conduit because it is located closer to the dirty air inlet 310 than the flexible hose 124. In examples of the surface cleaning apparatus that comprise both first and second air conduits 334, 124 the flexible hose 124 may be referred to as the downstream conduit because it is closer to the clean air outlet 420.

As exemplified in FIGS. 17-19, one example of the second air conduit 334 is a second flexible hose 335. In the preferred arrangement shown, the dirty air outlet 312 (also referred to as the surface cleaning head outlet) of the surface cleaning head 300 is connected to the second or upstream flexible hose 335 and the second flexible hose 335 extends from the dirty air outlet 312, through the hollow conduit member 330, through the hollow housing 268 to the upper collar 272. The downstream end of the second flexible hose 335 may be fixedly connected to the upper collar 272, or it may have a fitting that seats upon a surface of the upper collar 272 preventing the second flexible hose 335 from retracting within the hollow housing 268 while leaving the downstream end of the second flexible hose 335 free to extend upward, away from the upper collar 272.

The second flexible hose 335 forms part of the continuous airflow path or passageway that connects the dirty air outlet 312 of the surface cleaning head 300 to the opening 438 on the hand vacuum 400. To establish the continuous airflow passageway, the downstream end of the second upstream flexible hose 335 may be connected to the upstream end of the downstream flexible hose 124. The connection between the flexible hose 124 and the downstream end of the second flexible hose 335 is preferably a detachable connection so that the flexible hose 124 can be detached from the surface cleaning head 300 as described above.

Optionally, the second flexible hose 335 is also an extensible, or stretchable, hose that can extend when pulled on by the user. In some examples, the second flexible hose 335 is a stretch hose and may have a stretched length to non-stretched length ratio of between 2:1-6:1. In examples where the second flexible hose 335 is not stretchable, when a user removes the hand vacuum 400 from its mount during use, the maximum distance that the hand vacuum 400 can be separated from the backbone 200 and the surface cleaning head 300 is determined by the length of the flexible hose 124. However, in some instances, a user may wish to move the hand vacuum 400 a greater distance from the backbone 200, for example to pass the surface cleaning head 300 under a bed or other large piece of furniture. When a stretchable second flexible hose 335 is used, the downstream end of the second flexible hose 335 can unseat from the upper collar 272 and extend away from the bracket 260, whereby some of hose 335 may pass through housing 268 thereby lengthening the airflow conduit connecting the hand vacuum 400 to the surface cleaning head 300 and allowing the hand vacuum 400 to be moved further from the backbone 200 in use. Accordingly, it will be appreciated that some or all of the conduit that may be extended to provide additional length for an air flow passage may be stored on the surface cleaning head 300.

It will be appreciated that lower section 216 may be rotatably mounted on cleaning head 300 without hose 335 extending through a housing 268. Further, a housing 268 may be used even if lower section 216 is not rotatably mounted to cleaning head 300. Such a housing need not be pivotally mounted to surface cleaning head.

Preferably, the second flexible hose 335 is also resilient so that it will return to its original, un-stretched length when it is released by the user. The resilience of the second flexible hose 335 may tend to retract the second flexible hose 335 through the hollow housing 268 and the hollow conduit member 330 and may serve to re-seat the downstream end of the second flexible hose 335 on the upper collar 272. Optionally, the un-stretched or contracted length of the upstream or second flexible hose 335 may be less than the path length between the dirty air outlet 312 and the upper collar 272, so that the second flexible hose 335 is under tension even when the downstream end of the second flexible hose 335 is seated on the upper collar 272. This tension may help keep the downstream end of the second flexible hose 335 properly seated on the upper collar 272. When the second flexible hose 335 is resilient, it functions as a variable length air conduit and may reduce the need for a user to add extra hoses or conduit members to the vacuum 100 during use. Optionally, the first (or downstream) flexible hose 124 may also be stretchable and resilient.

To allow for easy and repeated extension of the second flexible hose 335, the second flexible hose 335 may be sized to freely pass through both the hollow conduit member 330 of the surface cleaning head 300 and the hollow housing 268 of the bracket 260.

In the example shown in FIG. 15-19, the hollow housing 268 is integral the bracket 260 and also serves as the coupling means that connects the lower portion 216 to the surface cleaning head 300. As shown, the coupling between the lower portion 216 and the surface cleaning head 300 may be the telescoping or overlapping engagement of the lower opening 270 over the surface cleaning head 300 hollow conduit member 330. In other examples, the coupling or attachment between the lower portion 216 and the surface cleaning head 300 may be any type of connection including a threaded connection, clamps or tabs. The connection between the lower portion 216 and the surface cleaning head 300 may be fixed or selectively releasable. An advantage of providing a single, downward facing coupling point 266 may be the fact that a single coupling point 266 can be pivotally and rotationally connected to the surface cleaning head 300. Further, the hollow conduit member 330 may be pivotally connected to the surface cleaning head 300, as exemplified in FIGS. 15-19, and in other examples, the hollow conduit member 330 may be fixedly connected to the surface cleaning head 300, or integrally formed therewith.

As shown, the hollow housing 268 may be integral with the bracket 260 and provide both a hollow passageway and an attachment point. However, in other examples, the hollow housing 268 may be external the bracket 260 and may be formed from a separate conduit. Similarly, the air flow conduit 110 connecting the attachment member 120 to the second flexible hose 335 may be the flexible hose 124 or any other suitable conduit, including flexible conduits, rigid conduits, conduits integral with the handle, as exemplified in FIG. 20, and conduits external the handle, as exemplified in FIGS. 1-5.

Optionally, the ribs 256 (or another portion of the second portion 216) may be surrounded by a housing or shell. The housing may provide structural strength to the second portion 216 or it may merely provide an improved aesthetic appearance of the vacuum 100, or both. If a housing is formed around a section of the second portion 216 (or any other section of the handle 210 or backbone 200) the mount for supporting the hand vacuum (for example the mount 220 or the saddle flanges 260) may be within a recess in the housing. Providing a recess in the housing for receiving the hand vacuum may create a more integrated or seamless visual appearance when the hand vacuum is mounted to the backbone 200; it may also improve the rigidity of the backbone 200.

As exemplified, wishbone portion 250 preferably extends forwardly and provides a mount for upper portion 214 (i.e. the handle) at a forward point of the backbone. Further, passageway 268 extends rearwardly. Accordingly, when hand vacuum 400 is mounted to the backbone, the centre of gravity of the backbone and hand vacuum 400 combined is below a plane P extending from the axle of rear wheel 320 to the upper end of upper portion 214 (as exemplified in FIG. 17), thereby improving maneuverability of surface cleaning head 300. It will be appreciated that other constructions, such as that exemplified in FIGS. 1-5, may be used to position the centre of gravity behind the plane. In the example shown (best exemplified in FIG. 5), the lower portion 216 includes an upper end that is connected to the hinge 218 such that the upper portion 214 is drivingly connected to the surface cleaning head 300. In this construction the lower end includes a step-back or kinked-back portion 215. The step-back portion 215 enables the mount 220 to be positioned sufficiently behind the rear wheels 320 such that the centre of gravity of the combination of the backbone 200 and the hand vacuum 400 is below the plane P. As a result of this configuration, the vacuum 100 may be more stable when rotated and maneuvered by the user, especially when upper portion 214 is rotated about hinge 218. Specifically, locating the centre of gravity of the combination of the hand vacuum 400 and the backbone 200 below the plane P may tend to reduce the over rotation of the backbone 200 or over-steer of the vacuum 100 in use, and may reduce the strain on a user's arm and wrist.

It will be appreciated that the dual hose construction (i.e. the flexible hose 124 and the second flexible hose 335 of FIG. 15-19) may be used in combination with any example disclosed herein or by itself in a surface cleaning apparatus. Similarly, the positioning of a removably mounted portable surface cleaning apparatus with a low centre of gravity may be used in combination with any example disclosed herein or by itself in a surface cleaning apparatus.

Referring now to FIGS. 6-14, examples of the portable cleaning apparatus 400 and the attachment member 120 of the vacuum 100 are shown in more detail. It will be appreciated that any portable surface cleaning apparatus may be used. Preferably, the portable surface cleaning apparatus uses cyclonic separation. More preferably, the portable surface cleaning apparatus is a hand vacuum cleaner.

The hand vacuum 400 can be operated as the vacuum suction supply for the vacuum 100 and it can be operated as a stand alone hand vacuum cleaner, that is movable along a surface to be cleaned by gripping and maneuvering handle 402, when it is removed from, or detached from the backbone 200. The hand vacuum 400 includes an upper portion 404, a lower portion 406, a front 408, and a rear 410. In the example shown, maneuvering handle 402 is provided at the upper portion 404. In alternate examples, maneuvering handle 402 may be provided elsewhere on the vacuum cleaner 400, for example at the rear 410.

In the example shown, the hand vacuum 400 comprises a nozzle 412 and a cyclone unit 414, which together preferably form a cleaning head portion 416 of the hand vacuum 400. In the example shown, the cleaning head portion 416 is provided at the front 408 of the hand vacuum 400.

Nozzle 412 comprises a dirty air inlet 418, through which dirty air is drawn into the portable cleaning apparatus 400, and when used as a hand vacuum cleaner the nozzle 412 directly engages a surface to be cleaned (such as floor A as shown in FIG. 6). An airflow passage extends from the dirty air inlet 418 to a clean air outlet 420 of the hand vacuum 400. In the example shown, clean air outlet 420 is at the rear 410 of the hand vacuum 400. It will be appreciated that clean air outlet may optionally be connected to a fluid conduit provided in the floor cleaning unit.

Cyclone unit 414 is provided in the airflow passage, downstream of the dirty air inlet 418. In the example shown, the cyclone unit 414 comprises one cyclone 422, and one dirt chamber 424. In alternate examples, the cyclone unit 410 may include more than one cyclone, and more than one dirt chamber. Further, the cyclones chambers may be arranged in stages, and may be provided in parallel or in sequence. Alternately, or in addition, one or more filters or other dirt separation members may be used.

In the example shown, the nozzle 412 is positioned at the lower portion 406 of the portable cleaning apparatus 400. More preferably, as in the example shown, nozzle 412 is positioned at the bottom of the portable cleaning apparatus 400, and is preferably beneath the cyclone unit 414 when used as a hand vacuum cleaner and is between the cyclone unit 414 and the mount 220 when attached to the backbone 200. Further, as in the example shown, the nozzle 412 is preferably fixedly positioned at the lower portion 406 of the portable cleaning apparatus 400. That is, the nozzle 412 is not movable with respect to the remainder of the portable cleaning apparatus 400, and is fixed at the lower portion 106 of the portable cleaning apparatus 400. As shown in FIGS. 7 and 8, nozzle 412 has a width WN and, as shown in FIG. 11, coupling plate 123 has a width Wp that is generally the same as width WN.

Nozzle 412 exemplifies a particular design for an open sided nozzle. Open sided nozzle 412 has an open side that faces the surface to be cleaned when the nozzle is placed against a surface to be cleaned. Accordingly, nozzle 412 defines an air flow chamber that has an open lower side. In operation, air will flow longitudinally through the air flow chamber to an air exit. It will be appreciated that only part of the nozzle may have an open lower side. Alternately, all of the nozzle, from an air inlet end to the air outlet, may have an open lower side. It will be appreciated that various other design may be used.

Referring now to FIGS. 8-14, nozzle 412 comprises an upper nozzle wall 426. In the example shown, the upper nozzle wall 426 comprises a portion 419 of a wall 415 of the cyclone unit. Nozzle 412 further preferably comprises a depending wall 428 extending downwardly from the upper nozzle wall 426. The depending wall 428 is generally U-shaped. The height of the depending wall may vary. The open end of the U-shape defines an open side wall 430 of the nozzle 414, and forms the dirty air inlet 418 of the portable cleaning apparatus 400. In the example shown, the open side wall 430 is provided at the front of the nozzle 414 and forms a portion of a flow passage that is in communication with the opening 438. When in use as a hand vacuum, optional wheels 435 are in contact with a surface and the open side wall 430 sits above and is adjacent a hard surface to be cleaned. It will be appreciated that depending wall 428 may be positioned only rearward of opening 438. Alternately, or in addition, depending wall 428 may be provided adjacent the lateral sides of opening 438. The depending walls may be discrete walls or they may be joined together as exemplified. The walls may be continuous or discontinuous.

In the example shown, the lower end 432 of the depending wall 428 defines an open lower end 434 of the nozzle 414. The open lower end 434 extends to the front 408 of the hand vacuum 400, and merges with the open side 430. In use, the open lower end 434 faces a surface to be cleaned. In the example shown, a plurality of wheels 435 are mounted to the depending wall 428, and extend below the lower end 432 of the depending wall 428. Accordingly, when in use as a hand vacuum, when wheels 435 are in contact with a surface, the lower end 432 of the depending wall 428 is spaced from a surface to be cleaned, and the space between the lower end of the depending wall 428 and the surface to be cleaned form a secondary dirty air inlet to the portable cleaning apparatus 400 when used as a hand vacuum.

The upper nozzle wall 426, depending wall 428, and open lower end 434 of the nozzle 412 define an airflow chamber 436 of the nozzle. An opening 438 is preferably provided in the upper nozzle wall 426, and is in communication with the airflow chamber 436. When in use as a hand vacuum, the wheels 435 are in contact with a surface, the opening 438 faces a surface to be cleaned, air enters the dirty air inlet 418, passes horizontally through the airflow chamber 436, and passes into the opening 438. Opening 438 is in communication with a cyclone inlet passage 439, which is in communication with a cyclone air inlet 440 of cyclone 422. In some embodiments, opening 438 need not be in upper wall 426.

Nozzle 412 and attachment member 120 are configured such that attachment member 120 may form part of the air flow conduit to opening 438 when attachment member 120 is mounted to hand vacuum 400. For example, when the portable cleaning apparatus 400 is used in combination with the backbone 200 and the surface cleaning head 300, the opening 438 in the nozzle 412 is in sealed, fluid communication with the air outlet 127 of the attachment member 120. By way of this connection, a continuous fluid pathway is established between the dirty air input 310 of the surface cleaning head 300 and the opening 438.

It will be appreciated that attachment member 120 may be removably mounted to nozzle 412 by any engagement means known in the connecting arts. Further, attachment member may be of any configuration. Attachment member may be part of, or may be connected to, an accessory cleaning tool by any means, such as a flexible hose. The flexible hose may be hose 110 if hose 110 is removably mounted to the floor cleaning unit.

As exemplified, attachment member 120 is removably engaged with nozzle 412 by the engagement of pivoting arms in slots provided on nozzle 412. Accordingly, for example, nozzle 412 may also include a slot 490 defining a recess in the depending wall 428 that is adjacent the upper nozzle wall 426. The slot 490 preferably extends continuously along the U-shaped portion of the nozzle depending wall 428 and may be bounded at each end by corners 492. The attachment member 120 includes two arms 150 each having a shoulder 154 and being pivotally connected to the coupling plate 123 using pins 156 (alternatively, the arms 150 could be resilient). FIG. 14 is a partially exploded view of the attachment member 120, illustrating one example of the rotational connection between the coupling 142 and the collar 140. In the example shown, the coupling 142 comprises a cylindrical body wall that passes through an opening in the collar 140. Once the coupling 142 had been inserted into the collar 140 it is retained using fastening clip 143. The combination of the coupling plate 123 and the arms 150 may also be described as connecting portion, mounting portion or nozzle mounting portion of the attachment member 120.

In order to assemble the mount on nozzle 412, coupling plate 123 may be slid into the open end of airflow chamber 436. Accordingly, when the coupling plate 123 of the attachment portion 120 is slid into the airflow chamber 436, the arms 150 are pressed together by the nozzle 412 walls until the point when arms 150 are aligned with slot 490 (i.e. when the shoulders 154 are advanced past the corners 492). When the arms 150 are aligned with the slot 490, the attachment member 120 is "clicked-in" or locked in place when the arms 150 spread apart and the shoulders 154 of the arms 150 become lodged behind the corners 492 of slot 490. The arms 150 may be manually separated or the attachment member may include a biasing means (not shown) that biases the arms 150 apart. With the arms 150 in the spread configuration the attachment member 120 cannot be slidingly removed from the nozzle 412. When a user wishes to detach the attachment means 120 from the nozzle 412 the user may squeeze upstanding tabs 152 together thereby allowing the shoulders 154 to slide past the corners 492. The mount may alternately be inserted by squeezing upstanding tabs 152 together so that plate 123 may be inserted in chamber 436.

When the hand vacuum 400 is coupled to the attachment member 120 the airflow chamber 436 may receive, and be partially filled with the coupling plate 123 of the attachment portion 120. The coupling plate 123 is preferably shaped to be slidingly received within the airflow chamber 436.

Insertion of the coupling plate 123 into the airflow chamber 436 serves to register the air outlet 127 with the nozzle opening 438. As shown, the air outlet 127 has a width Wo and a length Lo that are preferably the same as the width Wo and a length Lo of the opening 438. A sealing gasket 123 may provided at the juncture of the openings.

In some examples the portable surface cleaning apparatus 400 may be connected to the attachment member 120 using a complimentary tongue and groove connection, instead of or in addition to the arms 150 and slot 490 described above. As exemplified in FIG. 21, the nozzle 412 of the may contain a slot or groove 494. Optionally, the grooves 494 on each side of the nozzle 412 may be separate, or they may be different portions of a single continuous groove 494 (like the continuous slot 490). The grooves 494 are sized to receive corresponding tongues 170 extending from a surface of the attachment member 120. When the tongues 170 are slidingly received within the grooves 494 movement of the portable surface cleaning apparatus 400 is restrained in the sideways and forward-backward directions relative to the backbone 200.

The nesting of the tongues 170 into the grooves 494 can provide sufficient stability and support for the portable surface cleaning apparatus 400 that additional fasteners are not necessary. When the surface cleaning apparatus 100 is in use, the gravitation forces acting on the portable surface cleaning apparatus 400 are sufficient to keep it seated on the attachment member 120. The grooves 494 may have downward facing open ends that can engage the tongues 170 when the portable surface cleaning apparatus 400 is lowered onto the attachment member by the user in a vertical movement. To detach the portable surface cleaning apparatus 400 from the attachment member 120 the user may lift or slide the portable surface cleaning apparatus 400 upward to a disengaged position where the tongues 170 are removed from the grooves 494.

The attachment member 120 and the nozzle 412 may also include a plurality of magnets 158 that magnetically couple the attachment member 120 to the nozzle 412 to improve the connection between them and ensure that air outlet 127 is properly registered with opening 438. It will be appreciated that, in an alternate embodiment, only magnets maybe used. Other mounting means may be used. For example, a plurality of latches may be used or air outlet 127 may extend into opening 438.

Optionally, when the attachment member 120 is coupled to the portable cleaning apparatus 400, the upstream end of the air conduit 110 (for example hose 124) can be detached from the surface cleaning head 300 and the combination of the attachment member 120 and the flexible hose 124 (decoupled from the surface cleaning head 300) can serve as an auxiliary or accessory cleaning tool. The free end of the hose 124 may be maneuvered by the user to clean objects and surfaces that cannot be cleaned using the surface cleaning head 300. In some examples, the upstream end of the flexible hose 124 may be connected to the auxiliary cleaning tool 112. Alternatively, the flexible hose 124 may be removed from the attachment member 120 and the auxiliary cleaning tool 112 may be mounted directly to the air inlet 126 of the attachment member 120. It will be appreciated that tool 112 may have a plate 123 and arms 150 provided at the coupling end thereof.

Optionally, the attachment member 120 may be removed from the nozzle 412 and the auxiliary cleaning tool 112 may be fitted directly to the nozzle 412, without the use of a flexible hose 124 or other type intermediate air conduit. In addition to the auxiliary or accessory cleaning tool 112, the nozzle 412 may be directly connected to any one of a number of cleaning tools that have been provided with the an appropriate attachment member, including wands, brushes, crevasse tools and other hoses.

Clean air outlet 420 is provided downstream of the cyclone unit 414, suction motor 416*c* and optional post-motor filter 461*a* contained optionally within the cleaner body 460. Clean air outlet 420 may comprise a plurality of apertures formed in housing 461. The cleaner body 460 may also contain one or more of a separation plate, a dirt chamber a pre-motor filter 461*b* a plurality of connecting fluid conduits or passageways.

In the example shown, cleaner body 460 is removably mounted to head portion 416. For example, cleaner body 460 may be entirely removable from head portion 416, or pivotably mounted to head portion 416. Accordingly, cleaner body 460 and head portion 416 may be separated in order to provide access to the interior of cleaner body 460 or head portion 416. This may allow a pre-motor filter to be cleaned, changed, or serviced, or the motor to be cleaned, changed or serviced. Alternately, head portion 416 may be cleaned or serviced. For example, any dirt stuck in the enclosed passages portable cleaning apparatus 400 may be removed. Alternately, a replacement cleaner body 460 or head portion 416 may be provided, and may be mounted to an existing head portion 416 or cleaner body 460, respectively.

One or more additional rear wheels 480 may be mounted to housing 461 at lower portion 406, and may be used in conjunction with wheels 435 when the portable cleaning apparatus 400 is used as a hand vacuum. When the portable cleaning apparatus 400 is attached to the backbone 200 the additional wheel 480 preferably engages with the mount bracket 224 and partially supports the portable cleaning apparatus 400 on the handle 210 as described above.

Preferably, as exemplified, the portion of the attachment member 120 that is used to mount the attachment member to the backbone may also comprise part of the air flow path from surface cleaning head 300 to hand vacuum cleaner 400. For example, the attachment member 120 may include a mounting portion or collar 140 that includes a coupling 142 and defines a channel 144. The collar 140 is connected to the airflow passageway 128, or alternatively may be connected directly to the air conduit 110. Optionally, the coupling 142 is a rotatable coupling that allows the airflow passageway 128 to rotate relative to the collar 140. The upstream end of the airflow passageway 128 defines the air inlet 126. In operation, the air inlet 126 is preferably coupled to the airflow conduit 110 that extends to the surface cleaning head 300 (the flexible air hose 124 in the example shown). The air inlet 126 is releasably coupled to the flexible air hose by clips 160. Downstream of the coupling 142 an enclosed airflow passage connects the airflow passage 128 to the air outlet 127. It will be appreciated that the attachment member 120 need not comprise part of the air flow passage. For example, coupling 142 may be located out of the flow path defined by passageway 128. Alternately, plate 123 need not have opening 127. Accordingly, attachment member may have a first part that is secured to hand vacuum 400 and a second distinct part that completes that air flow passage from surface cleaning head 300 to opening 438.

The airflow passageway 128 may be flexible or rigid and may be generally straight or may have a curved shape, as shown. Preferably, the curved airflow passageway 128 subtends fewer than 45 degrees.

It will be appreciated that the construction of the portable surface cleaning apparatus nozzle and/or an open sided nozzle that it is selectively connectable in air flow communication with a remote cleaning head and/or a mount of a support structure may each be used by themselves or with any other feature disclosed herein.

It will also be appreciated that the construction of a surface cleaning apparatus including an airflow conduit comprising two flexible hose members may be used by itself or with any other feature disclosed herein.

It will be further appreciated that the construction of a surface cleaning apparatus in which a flexible hose extends through a pivot mount may be used by itself or with any other feature disclosed herein.

It will be further appreciated that the construction of a surface cleaning apparatus including a portion of the airflow conduit formed by a flexible hose that is under tension may be used by itself or with any other feature disclosed herein.

It will be further appreciated that any construction of an upright structure for a surface cleaning apparatus may be used by itself or with any other feature disclosed herein.

In addition, any of the features disclosed herein may be used by themselves, or with any other feature.

What has been described above has been intended to be illustrative of the invention and non-limiting and it will be understood by persons skilled in the art that other variants and modifications may be made without departing from the scope of the invention as defined in the claims appended hereto.

The invention claimed is:

1. A surface cleaning apparatus comprising a nozzle, an air outlet and an enclosed airflow passage from the nozzle to the air outlet, an air treatment unit and a suction motor in the airflow passage, the nozzle comprising an airflow chamber having an upper wall, side walls depending downwardly from the upper wall and an open lower side positioned between the side walls and, in a first operating mode, the nozzle directly faces a surface to be cleaned, the air flow chamber is configured for rearward flow of air from a front end of the nozzle to an opening to the enclosed airflow passage provided in the upper wall and, in a second operating mode, the nozzle is selectively connected in air flow communication with a remote cleaning head.

2. The surface cleaning apparatus of claim 1 wherein the remote cleaning head comprises at least one of an accessory cleaning tool and a surface cleaning head provided on an upright vacuum cleaner.

3. The surface cleaning apparatus of claim 2 further comprising a portable surface cleaning apparatus that comprises the nozzle, the air outlet, the enclosed airflow passage, the air treatment unit and the suction motor, and in the second operating mode, the portable surface cleaning apparatus is removably mounted to the upright vacuum cleaner, the upright vacuum cleaner comprising a handle that is drivingly connected to the surface cleaning head having a dirty air inlet.

4. The surface cleaning apparatus of claim 3 wherein the nozzle is selectively connectable in air flow communication with the accessory cleaning tool and the surface cleaning head.

5. The surface cleaning apparatus of claim 3 wherein the airflow chamber further comprises at least one open side wall and defines a flow passage such that air travels from the at least one open side wall under the portable surface cleaning apparatus to the opening.

6. The surface cleaning apparatus of claim 5 further comprising an attachment member that is mountable to the portable surface cleaning apparatus.

7. The surface cleaning apparatus of claim 6 wherein the attachment member has an attachment member air inlet that is in airflow communication with an air flow conduit extending from the surface cleaning head.

8. The surface cleaning apparatus of claim 7 wherein the attachment member comprises a mounting portion removably connectable with the portable surface cleaning apparatus and the attachment member air inlet is provided on the mounting portion.

9. The surface cleaning apparatus of claim 3 further comprising an attachment member connectable in fluid flow communication with the opening, wherein the attachment member is releasably secured to the portable surface cleaning apparatus by a pair of opposed pivotal arms.

10. The surface cleaning apparatus of claim 9 wherein the arms are provided on the attachment member and are releasably secured to the portable surface cleaning apparatus.

11. The surface cleaning apparatus of claim 3 wherein the portable surface cleaning apparatus is removably mounted to the handle.

12. The surface cleaning apparatus of claim 3 wherein the portable surface cleaning apparatus is removably mounted to the handle and the surface cleaning apparatus further comprises a flexible hose extending from the surface cleaning head to the portable surface cleaning apparatus.

13. The surface cleaning apparatus of claim 3 wherein the portable surface cleaning apparatus comprises a hand vacuum cleaner and the nozzle is configured for directly cleaning a surface.

14. The surface cleaning apparatus of claim 1 further comprising at least one attachment member, the attachment member is connectable in fluid flow communication with the opening.

15. The surface cleaning apparatus of claim 14 wherein the at least one attachment member comprises an auxiliary cleaning tool.

16. The surface cleaning apparatus of claim 15 wherein the attachment member comprises a mounting portion removably connectable with the surface cleaning apparatus and a flexible hose extending from the auxiliary cleaning tool to the mounting portion.

17. The surface cleaning apparatus of claim 14 comprising an upright vacuum cleaner and a portable surface cleaning apparatus that comprises the nozzle, the air outlet, the enclosed airflow passage, the air treatment unit and the suction motor, and in the second operating mode, the portable surface cleaning apparatus is removably mounted to the upright vacuum cleaner, wherein the at least one attachment member comprises a first attachment member comprising an auxiliary cleaning tool and a second attachment member that is mountable to the portable surface cleaning apparatus and has an air inlet that is in airflow communication with an air flow conduit extending from the surface cleaning head.

18. The surface cleaning apparatus of claim 14 comprising an upright vacuum cleaner and a portable surface cleaning apparatus that comprises the nozzle, the air outlet, the enclosed airflow passage, the air treatment unit and the suction motor, and in the second operating mode, the portable surface cleaning apparatus is removably mounted to the upright vacuum cleaner, wherein the attachment member that is removably mountable to the portable surface cleaning apparatus and comprises a flexible hose that is connectable with an auxiliary cleaning tool and a surface cleaning head provided on the upright vacuum cleaner.

19. The surface cleaning apparatus of claim 14 wherein the attachment member has an air inlet and an attachment member passageway extends in a downstream direction from the air inlet to the opening and the attachment member passageway does not increase in diameter in the downstream direction.

20. The surface cleaning apparatus of claim 14 wherein the attachment member has an air inlet, an attachment member passageway extends in a downstream direction from the air inlet to the opening, and air traveling from the air inlet to the opening passes through less than a 45° bend.

21. The surface cleaning apparatus of claim 14 wherein the attachment member has an air inlet, an attachment member passageway extends in a downstream direction from the air inlet to the opening, and air traveling from the air inlet to the opening travels in a generally straight line.

22. The surface cleaning apparatus of claim 14 wherein the attachment member is releasably secured to the portable surface cleaning apparatus by at least one magnet.

23. The surface cleaning apparatus of claim 14 comprising an upright vacuum cleaner having a handle and a portable surface cleaning apparatus that comprises the nozzle, the air outlet, the enclosed airflow passage, the air treatment unit and the suction motor, and in the second operating mode, the portable surface cleaning apparatus is removably mounted to the upright vacuum cleaner, wherein the portable surface cleaning apparatus is removably mounted to the handle and the surface cleaning apparatus further comprises a flexible hose extending from a surface cleaning head provided on the upright vacuum cleaner to the attachment member.

24. An upright vacuum cleaner comprising:

(a) a portable surface cleaning apparatus comprising a first enclosed airflow passage extending from a first nozzle to an air outlet, an air treatment unit and a suction motor in the airflow passage, the first nozzle comprising an airflow chamber having an upper wall having an inlet to the first enclosed air flow passage, side walls depending downwardly from the upper wall and an open lower side positioned between the side walls;

(b) a surface cleaning head comprising a second enclosed airflow passage extending from a second nozzle to the portable surface cleaning apparatus; and, (c) a handle drivingly connected to the surface cleaning head wherein the portable surface cleaning apparatus is removably mounted to the upright vacuum cleaner via the first nozzle.

25. The upright vacuum cleaner of claim 24 wherein the portable surface cleaning head is removably mounted to the handle.

26. The upright vacuum cleaner of claim 24 further comprising an attachment member removably mountable to the first nozzle, the attachment member comprising an attachment member air flow passage extending from an inlet end and in air flow communication with the first nozzle when the attachment member is mounted to the first nozzle.

27. The upright vacuum cleaner of claim 26 wherein the attachment member air flow passage comprises a flexible hose.

28. An upright vacuum cleaner comprising:

(a) a portable surface cleaning apparatus comprising a first airflow passage extending from a first nozzle to an air outlet, an air treatment unit and a suction motor in the airflow passage, the first nozzle comprising an airflow chamber having an upper wall having an inlet to the first enclosed air flow passage, side walls depending downwardly from the upper wall and an open lower side positioned between the side walls;

(b) an attachment member removably mountable to the first nozzle, the attachment member comprising an attachment member air flow passage extending from an inlet end and in air flow communication with the first nozzle when the attachment member is mounted to the first nozzle, the attachment member air flow passage comprising a flexible hose and a rotatable rigid coupling downstream of the flexible hose;

(c) a surface cleaning head comprising a second airflow passage extending from a second nozzle to the portable surface cleaning apparatus; and, (d) a handle drivingly connected to the surface cleaning head wherein the portable surface cleaning head is removably mounted to the upright vacuum cleaner via the first nozzle.

29. The upright vacuum cleaner of claim 28 wherein the portable surface cleaning apparatus is removably mounted to the handle.

30. The upright vacuum cleaner of claim 29 wherein the first nozzle has a nozzle wall with an inlet and the nozzle wall faces a wall of the handle which has an outlet when the portable surface cleaning head is mounted to the upright vacuum cleaner.

31. The upright vacuum cleaner of claim 30 wherein the outlet faces forward.

32. The upright vacuum cleaner of claim 28 wherein the rotatable rigid coupling comprises an elbow.

33. The upright vacuum cleaner of claim 28 wherein the first nozzle has a nozzle wall with an inlet and the nozzle wall faces a wall of the upright vacuum cleaner which has an outlet when the portable surface cleaning head is mounted to the upright vacuum cleaner.

34. The upright vacuum cleaner of claim 33 wherein the outlet faces forward.

* * * * *